US012599823B2

(12) United States Patent
Alvarez

(10) Patent No.: US 12,599,823 B2
(45) Date of Patent: Apr. 14, 2026

(54) PORTABLE DISC SPORT TRAINING APPARATUS

(71) Applicant: Visionary Disc Golf LLC, Vineland, NJ (US)

(72) Inventor: Luis Daxel Alvarez, Vineland, NJ (US)

(73) Assignee: Visionary Disc Golf LLC

( * ) Notice: Subject to any disclaimer, the term of this patent is extended or adjusted under 35 U.S.C. 154(b) by 549 days.

(21) Appl. No.: 18/081,707

(22) Filed: Dec. 15, 2022

(65) Prior Publication Data

US 2023/0191218 A1 Jun. 22, 2023

Related U.S. Application Data

(60) Provisional application No. 63/290,666, filed on Dec. 17, 2021.

(51) Int. Cl.
*A63B 67/06* (2006.01)
*A63B 71/02* (2006.01)

(52) U.S. Cl.
CPC ..... *A63B 67/06* (2013.01); *A63B 2071/024* (2013.01); *A63B 2210/50* (2013.01)

(58) Field of Classification Search
CPC ... A63B 63/00; A63B 2063/001; A63B 67/06; A63B 71/022
See application file for complete search history.

(56) References Cited

U.S. PATENT DOCUMENTS 4,127,267 A * 11/1978 Bay ..... A63B 63/00 473/421
4,750,744 A 6/1988 Michalec
5,042,813 A * 8/1991 Huang ..... A63B 67/02 473/197
5,730,666 A 3/1998 Hudson
9,604,112 B2 3/2017 Gilman
D900,933 S * 11/2020 Tanoury ..... D21/305
D1,029,971 S * 6/2024 Tsang ..... D21/705
(Continued)

FOREIGN PATENT DOCUMENTS

FR 2640514 A1 * 6/1990 ..... A63B 63/00

OTHER PUBLICATIONS

English machine translation of FR-2640514-A1 (Roustan) (Year: 1990).*

*Primary Examiner* — Laura Davison
(74) *Attorney, Agent, or Firm* — Ashok Tankha

(57) ABSTRACT

A portable training apparatus including a collapsible frame and a net is provided. The collapsible frame includes a pair of base supports, a pair of vertical poles, and a horizontal pole. The base supports rest on a support surface. Each vertical pole is secured to a mid-section of a corresponding base support and projects upwards therefrom. The horizontal pole is disposed generally perpendicular to the vertical poles and is secured between the mid-sections of the base supports. The net is releasably secured to the vertical poles and the horizontal pole. The net includes one or more pockets built thereinto for receiving and retaining a sporting projectile, for example, a disc, thrown thereinto during practicing of disc golf drives, approach shots, and putts. Each pocket includes a top opening and a bottom opening integrated into the net for receiving and allowing removal of the sporting projectile, respectively.

19 Claims, 26 Drawing Sheets

(56) References Cited

U.S. PATENT DOCUMENTS

| | | | | |
|---|---|---|---|---|
| 2005/0187036 | A1* | 8/2005 | Ziola | A63B 63/00 473/372 |
| 2009/0280931 | A1 | 11/2009 | Barber | |
| 2014/0171225 | A1* | 6/2014 | Paulson | A63B 63/00 473/421 |
| 2015/0352421 | A1 | 12/2015 | Candello | |
| 2017/0095716 | A1* | 4/2017 | Lewis | A63B 69/40 |
| 2017/0106266 | A1* | 4/2017 | Nelson | A63B 69/002 |
| 2017/0189774 | A1* | 7/2017 | Ferrari | A63B 71/023 |
| 2019/0046856 | A1 | 2/2019 | Nelson et al. | |

* cited by examiner

PORTABLE DISC SPORT TRAINING APPARATUS

CROSS-REFERENCE TO RELATED APPLICATIONS

This application claims priority to and the benefit of the provisional patent application titled "A Portable Training Apparatus For Practicing Disc Golf Drives, Approach Shots, And Putts", application No. 63/290,666, filed in the United States Patent and Trademark Office on Dec. 17, 2021. The specification of the above referenced patent application is incorporated herein by reference in its entirety.

FIELD OF THE INVENTION

The apparatus disclosed herein, in general, relates to disc sport training. More particularly, the apparatus disclosed herein relates to a portable training apparatus for allowing users to practice different shots or throws, for example, disc golf drives, approach shots, and putts.

BACKGROUND

Disc golf has become a growing sport in recent years. Unlike traditional golf that requires a golf club and a ball, disc golf is a flying disc sport in which players, referred to as disc golfers, throw a flying disc into each of a series of targets on an outdoor course, the objective being to complete a course using fewest possible throws. The targets are typically metal baskets with a chain net configured to catch the flying discs. Disc golf is typically played on an outdoor course composed of 9 or 18 holes. On each hole, players attempt to reach a target by throwing a flying disc towards the target, starting at a tee area or a tee pad. The target is reached only when the flying disc falls into the basket. The throw is repeated from where the flying disc landed on the first throw, until the flying disc is thrown into the basket. The number of throws made by a player to reach the target is recorded and compared with a par. The term "par" refers to an established, average number of throws expected from a player to hit the target. Most holes in disc golf are, for example, about 60 meters to about 150 meters long, and a player is typically allowed three shots or throws in order to make the par for the hole. The player who completes the course with the fewest number of throws wins the game.

Typical throws in disc golf comprise drives, approach shots, and putts. A drive typically refers to a first throw or shot from a tee pad or from a fairway designed for maximum distance. An approach shot, also referred to as an upshot, is typically the second throw or shot, after the initial drive, designed to position the flying disc within putting distance. A putt is the final throw, typically within a 10-meter radius of the target, aimed at getting the flying disc to fall into the basket. A conventional disc golf practice basket is only designed for putting practice. These practice baskets only allow players to practice their putts in their back yard or on the go. Currently, if a player wants to practice their drives and approach shots, the player has to travel to a disc golf course or an open field in order to throw their discs at a high speed without worrying about hitting anyone or causing any damage.

Furthermore, when players perform multiple repetitions (reps) of throws during training, the flying discs thrown typically collect and bundle up in pockets provided in conventional nets, after they hit the target, resulting in sagging of the nets, thereby disallowing players from training at a consistent level in their practice games.

Therefore, there is a long-felt need for a portable training apparatus that allows players to practice different shots or throws, for example, drives and approach shots, in their back yard or on the go, in addition to practicing their putts. Furthermore, there is a need for a mechanism that conveniently funnels sporting projectiles, for example, flying discs, that hit their target, and allows easy retrieval and removal of the sporting projectiles out of pockets of a net, to prevent sagging of the net.

SUMMARY OF THE INVENTION

This summary is provided to introduce a selection of concepts in a simplified form that are further disclosed in the detailed description of the invention. This summary is not intended to determine the scope of the claimed subject matter.

The apparatus disclosed herein addresses the above-recited need for a portable training apparatus that allows players to practice different shots or throws, for example, drives and approach shots, in their back yard or on the go, in addition to practicing putts. The apparatus disclosed herein further addresses the above-recited need for a mechanism that conveniently funnels sporting projectiles, for example, flying discs, that hit their target, and allows easy retrieval and removal of the sporting projectiles out of pockets of a net, to prevent sagging of the net. The portable training apparatus is configured for training users, for example, players who play flying disc sports such as disc golf, also referred to as disc golfers. The portable training apparatus saves users a trip to a disc golf course for disc golf training and practice. Moreover, the portable training apparatus optimizes training sessions as the portable training apparatus reduces time it would take to find and retrieve the sporting projectiles in an open field, thereby allowing users to throw many more shots in a shorter amount of time and maximizing training sessions.

The portable training apparatus disclosed herein comprises a collapsible frame and a net. The collapsible frame comprises a pair of base supports, a pair of vertical poles, and a horizontal pole. The pair of base supports is configured to rest on a support surface, for example, a ground surface. In an embodiment, each of the pair of base supports is of a generally V-shape, where a mid-section of each of the pair of base supports corresponds to a vertex of the generally V-shape. The mid-section of one of the pair of base supports faces the mid-section of the other one of the pair of base supports when the collapsible frame is assembled. In an embodiment, the mid-section of each of the pair of base supports comprises a vertical holder and a horizontal holder. The horizontal holder is disposed substantially perpendicular to the vertical holder. The vertical holder is configured to secure one of the pair of vertical poles. The horizontal holder is configured to secure one end of the horizontal pole.

The pair of vertical poles corresponds to the pair of base supports. Each of the vertical poles is secured to the mid-section of a corresponding one of the base supports. Each of the vertical poles projects upwards from the corresponding one of the base supports. In an embodiment, each of the vertical poles comprises at least two poles comprising a lower pole and an upper pole detachably attachable to each other and configured to span a height of the net. In an embodiment, the portable training apparatus further comprises a knob affixed to an upper end of the upper pole of each of the pair of vertical poles. The knob comprises multiple circumferential grooves defined along a length of the knob and configured to secure the net using fastening elements, for example, ties, cords, etc. In an embodiment, each of the pair of vertical poles is a telescopic pole configured to adjust height of each vertical pole for spanning a height of the net. The horizontal pole is disposed generally perpendicular to the pair of vertical poles. The horizontal pole is secured between the mid-sections of the pair of base supports. In an embodiment, the horizontal pole comprises at least two poles comprising a first pole and a second pole detachably attachable to each other and configured to span a width of the net. In an embodiment, the horizontal pole is a telescopic pole configured to adjust width of the horizontal pole for spanning a width of the net.

In an embodiment, the portable training apparatus further comprises multiple U-shaped stakes configured to secure the pair of base supports and the horizontal pole of the collapsible frame to the support surface. In an embodiment, the collapsible frame comprising the base supports, the vertical poles, and the horizontal pole, is configured for disassembly and storage. In an embodiment, the collapsible frame and the net are configured for storage within a bag, for example, a fabric bag. In an embodiment, the collapsible frame of a first size is reconfigurable into collapsible frames of multiple second sizes smaller than the first size for accommodating nets of different sizes, thereby allowing interchangeability of setups of the portable training apparatus based on user preferences.

The net is releasably secured to the pair of vertical poles and the horizontal pole of the collapsible frame. The net comprises one or more pockets built into the net and configured to retain a sporting projectile, for example, a golf disc, a ball, etc. Each pocket comprises a top opening integrated into the net for receiving the sporting projectile, and a bottom opening integrated into the net for allowing removal of the sporting projectile. In an embodiment, the top opening of the pocket(s) is substantially larger than the bottom opening of the pocket(s). The top opening of the pocket(s) is, for example, of one of a circular shape, a generally rectangular shape, a generally square shape, a polygonal shape, and an elliptical shape. The bottom opening of the pocket(s) is, for example, of one of a slit shape, a circular shape, a polygonal shape, and an elliptical shape.

In an embodiment, the pocket(s) of the net is configured to direct the sporting projectile towards the bottom opening of the pocket after the sporting projectile enters the pocket from the top opening of the pocket. The bottom opening of the pocket(s) of the net is disposed proximal to the support surface. The sporting projectile that enters the corresponding pocket is directed to rest on the support surface to prevent snagging of the net. In an embodiment with multiple pockets, the pockets comprise a pair of outer pockets and a center pocket. The outer pockets are configured to receive the sporting projectile thrown thereto during practicing of disc golf drives and approach shots. The center pocket is configured to receive the sporting projectile thrown thereto during practicing of putts. The center pocket and the pair of outer pockets are configured with multiple different dimensions.

In an embodiment, each of the pockets of the net further comprises a return channel defined between the top opening and the bottom opening of each of the pockets for receiving, retaining, and directing the sporting projectile towards the bottom opening of a corresponding pocket to rest on the support surface, after the sporting projectile enters the corresponding pocket from the top opening of the corresponding pocket, for retrieval and removal of the sporting projectile, thereby precluding sagging of the net due to weight of multiple sporting projectiles piled or stacked within the pockets.

In an embodiment, the portable training apparatus further comprises a pair of wheel assemblies operably coupled to the pair of base supports of the collapsible frame. The wheel assemblies are configured to move, transport, and position the portable training apparatus on the support surface. A locking element is operably coupled to each of the wheel assemblies. The locking element is configured to lock each of the wheel assemblies and brake the movement of the portable training apparatus on the support surface.

In a prophetic embodiment, the portable training apparatus further comprises multiple sensors operably coupled to multiple predetermined locations of the net. The predetermined locations comprise, for example, the top opening and the bottom opening of the pocket(s) of the net, a periphery of the net, in and/or around the pocket(s) of the net, etc. The sensors are configured to detect an impact of the sporting projectile on an impact location of the net, and measure a distance between the impact location and the top opening of the pocket(s) of the net. In an embodiment, the portable training apparatus further comprises a mobile application deployed on an electronic device, for example, a mobile device, in operable communication with the sensors on the net. The mobile application is configured to receive and analyze sensor data associated with the detected impact from the sensors; generate analytics results from the analyzed sensor data to assist in determining performance of a user; and generate recommendations based on the analytics results to assist in training the user. In an embodiment, the mobile application communicates with a computer system, for example, a server or a network of servers, via a network, for performing the analysis and analytical processing functions disclosed above.

These and further structures and features of the apparatus will be apparent with reference to the following description and drawings. In the description and the drawings, particular embodiments of the apparatus have been disclosed in detail as being indicative of some of the ways in which the concept of the apparatus may be employed; however, the apparatus is not limited correspondingly in scope. Rather, the apparatus includes all changes, modifications, and equivalents within the spirit and terms of the claims.

Structures and features that are disclosed and/or illustrated with respect to one embodiment may be used in the same way or in a similar way in one or more other embodiments and/or in combination with or instead of the structures and the features of the other embodiments.

BRIEF DESCRIPTION OF THE DRAWINGS

The foregoing summary, as well as the following detailed description of the invention, is better understood when read in conjunction with the appended drawings. For illustrating the embodiments herein, exemplary constructions of the embodiments are shown in the drawings. However, the embodiments herein are not limited to the specific components and structures disclosed herein. The description of a component or a structure referenced by a numeral in a drawing is applicable to the description of that component or structure shown by that same numeral in any subsequent drawing herein.

DETAILED DESCRIPTION OF THE INVENTION

Figure 1:
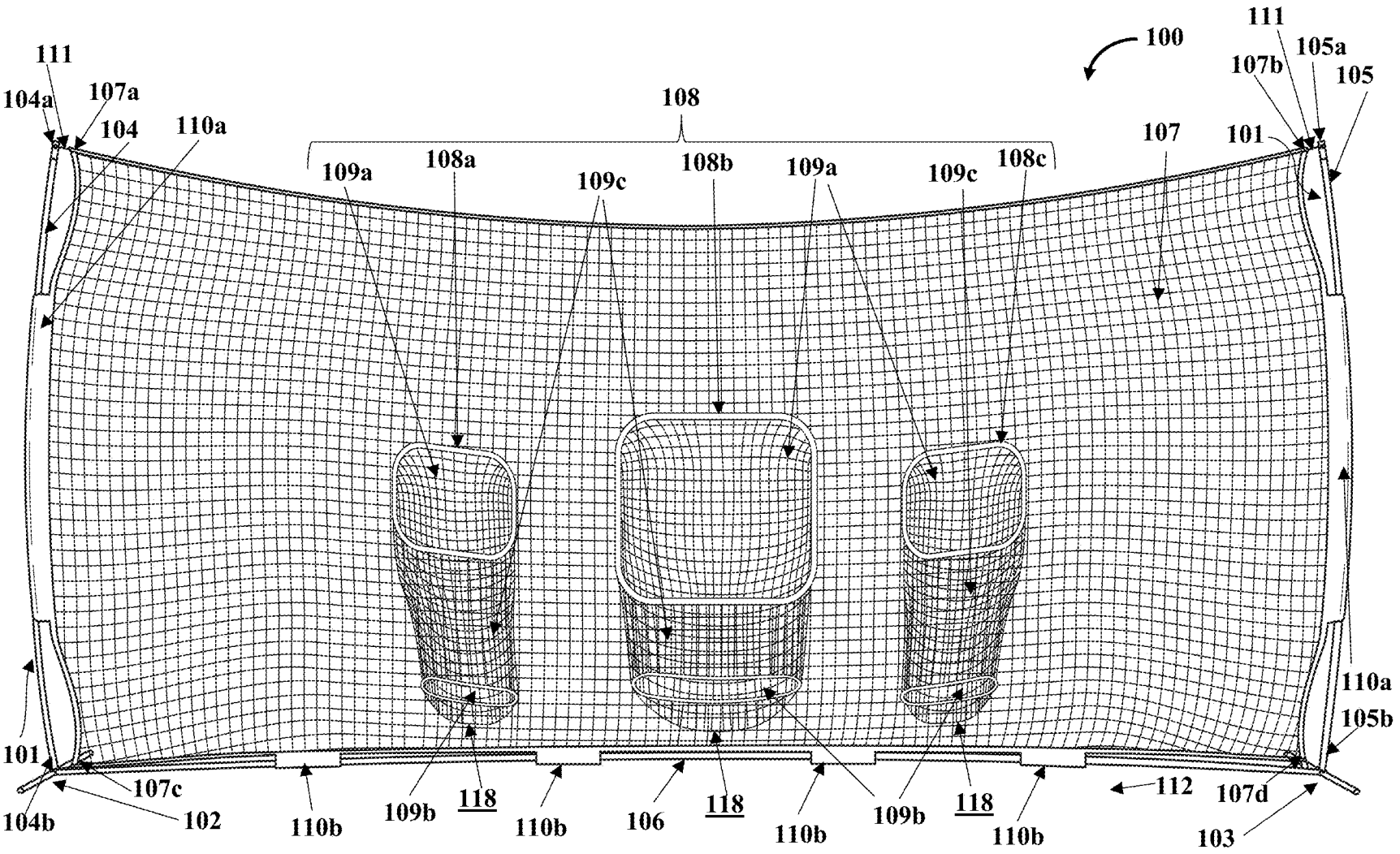
FIG. 1 illustrates a front view of an embodiment of a portable training apparatus comprising a collapsible frame and a net with multiple pockets built into the net, where each pocket comprises a top opening and a bottom opening integrated into the net.

FIG. 1 illustrates a front view of an embodiment of a portable training apparatus 100 comprising a collapsible frame 101 and a net 107 with multiple pockets 108 built into the net 107, where each of the pockets 108 comprises a top opening 109*a* and a bottom opening 109*b* integrated into the net 107. The collapsible frame 101 of the portable training apparatus 100 comprises a pair of base supports 102 and 103, a pair of vertical poles or rods 104 and 105 corresponding to the pair of base supports 102 and 103, and a horizontal pole 106. The pair of base supports 102 and 103 is configured to rest on a support surface 112, for example, a ground surface. The base supports 102 and 103 support the portable training apparatus 100 on the support surface 112. The vertical poles 104 and 105 of the collapsible frame 101 are secured to mid-sections 102*c* and 103*c* of the base supports 102 and 103, respectively, illustrated in FIG. 4A. Furthermore, the vertical poles 104 and 105 project upwards from the base supports 102 and 103, respectively. The horizontal pole 106 of the collapsible frame 101 is disposed generally perpendicular to the pair of vertical poles 104 and 105. The horizontal pole 106 is secured between the mid-sections 102*c* and 103*c* of the pair of base supports 102 and 103, respectively. The collapsible frame 101 comprising the pair of base supports 102 and 103, the pair of vertical poles 104 and 105, and the horizontal pole 106, is configured for disassembly and storage when not in use. The collapsible frame 101 illustrated in FIG. 1 is configured for a portable training apparatus 100 of size, for example, 22 feet wide×10 feet high. In an embodiment, the collapsible frame 101 of a first size is reconfigurable into collapsible frames of multiple second sizes smaller than the first size for accommodating nets 107 of different sizes as disclosed in the descriptions of FIG. 5E and FIGS. 6A-6E, thereby allowing interchangeability of setups of the portable training apparatus 100 based on user preferences.

Figure 3A:
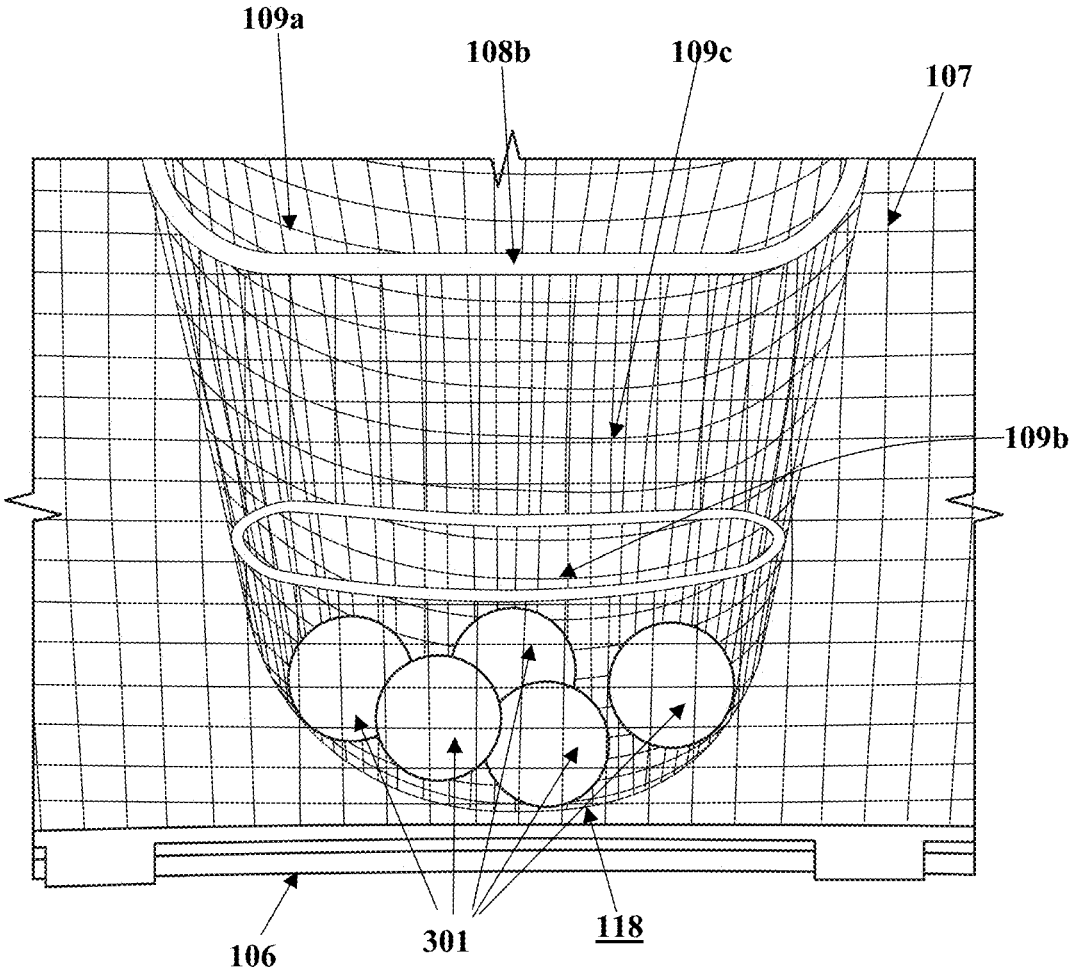
FIG. 3A illustrates an enlarged view of a pocket built into the net of the portable training apparatus shown in FIG. 1, showing multiple sporting projectiles retained within the pocket, proximal to the bottom opening of the pocket.
Figure 3B:
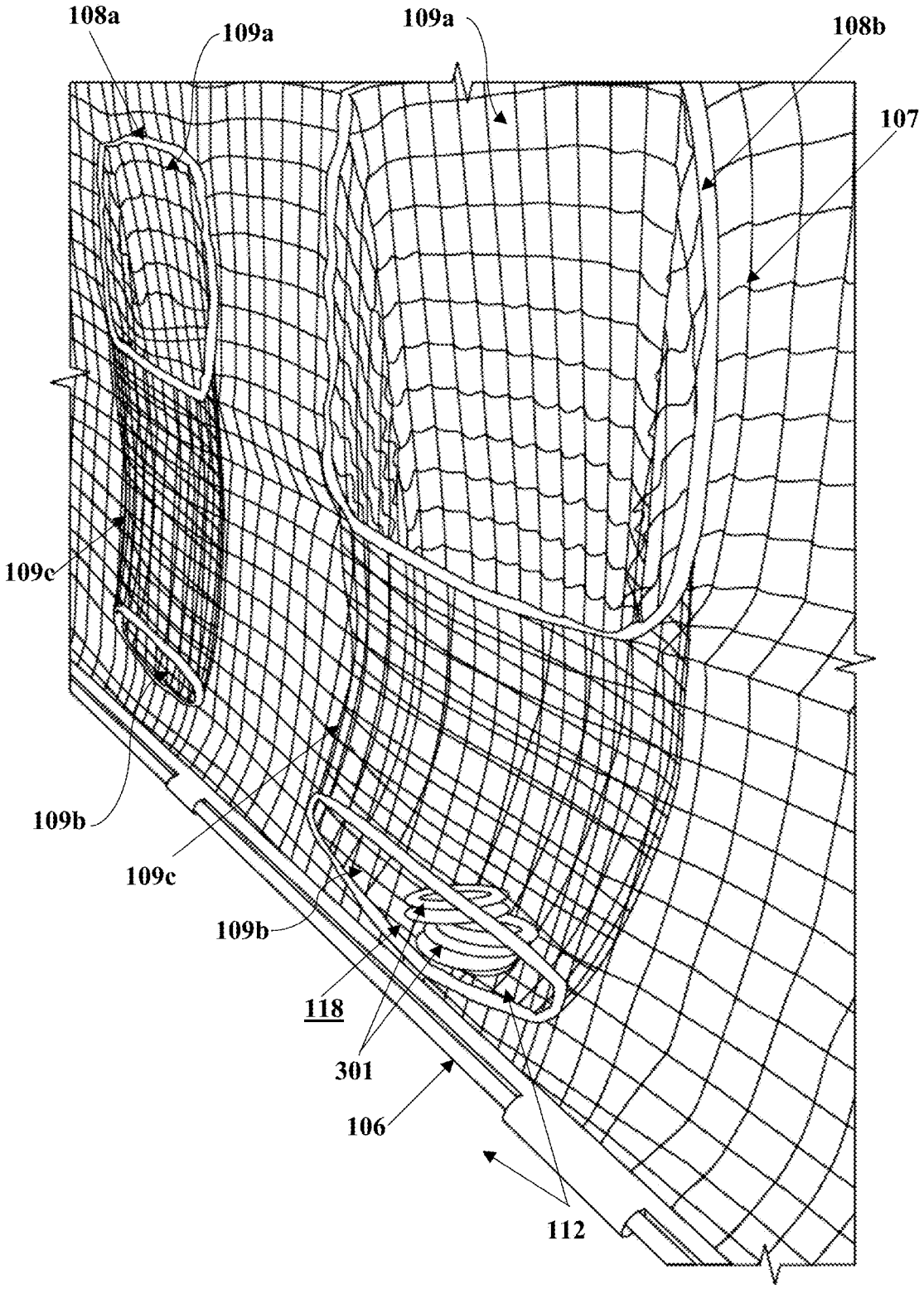
FIG. 3B illustrates a partial side perspective view of the net of the portable training apparatus shown in FIG. 1, showing multiple sporting projectiles funneled by a return channel of a pocket built into the net, to rest on a support surface, proximal to the bottom opening of the pocket.
Figure 5A:
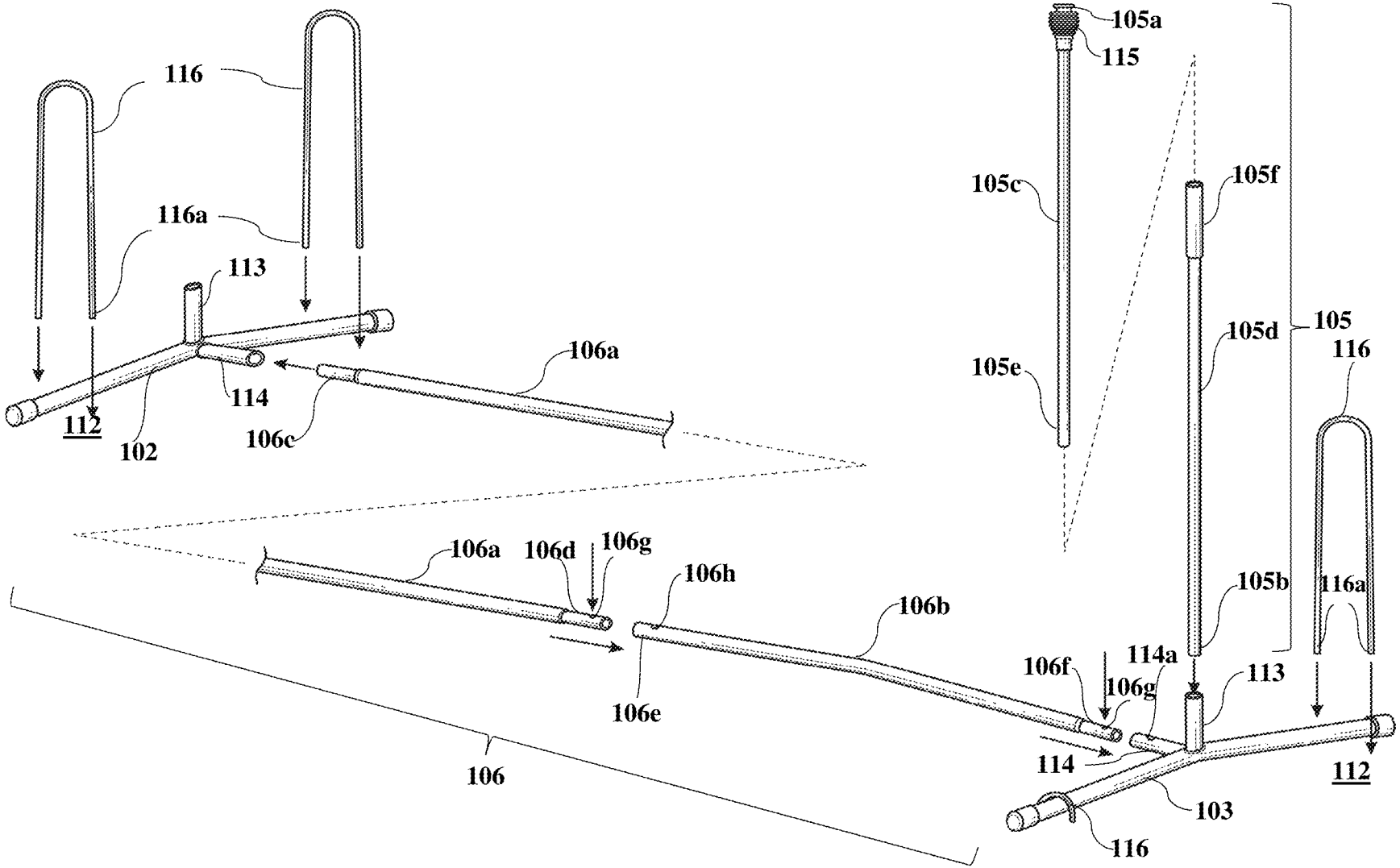
FIGS. 5A-5E illustrate an embodiment of a method for assembling the portable training apparatus.
Figure 5B:
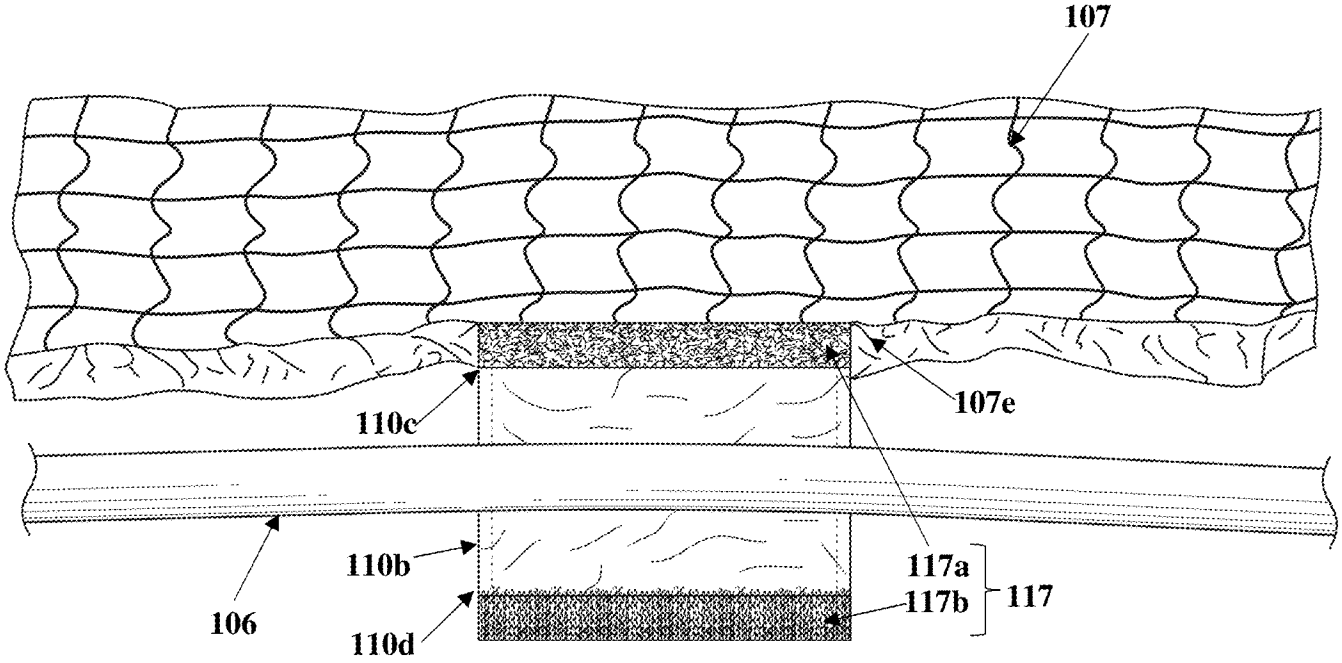
Figure 5C:
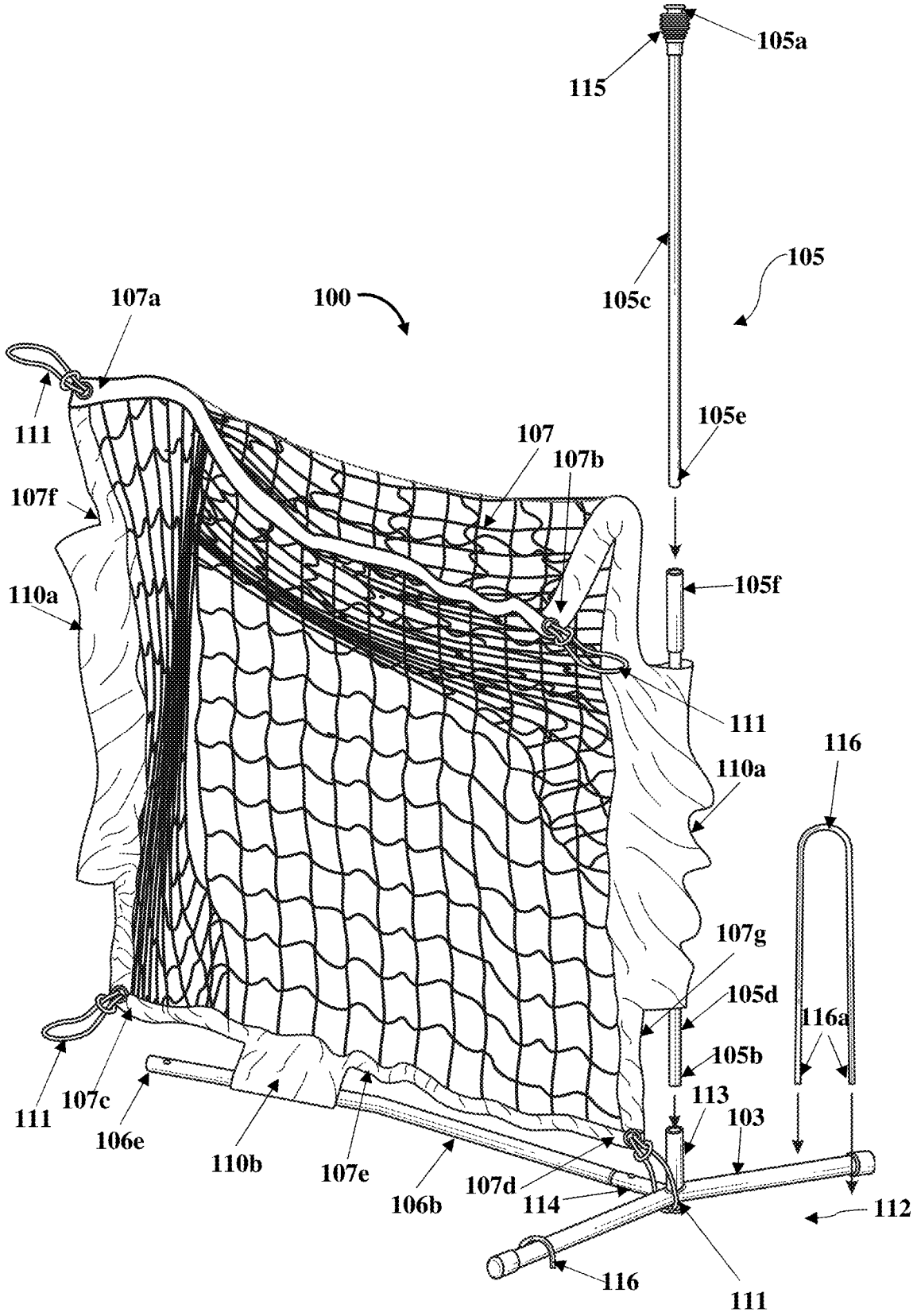
Figure 5D:
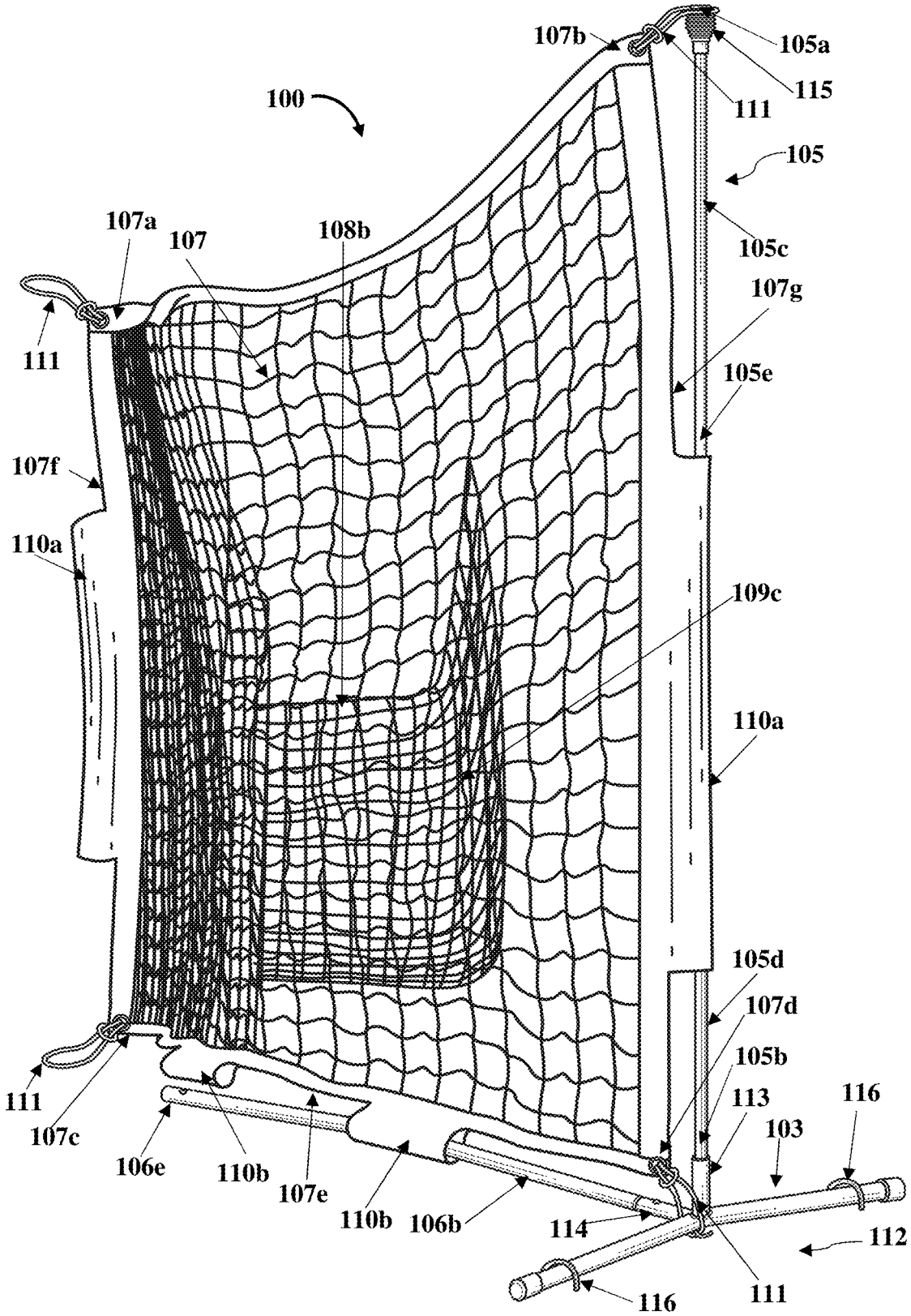
Figure 5E:
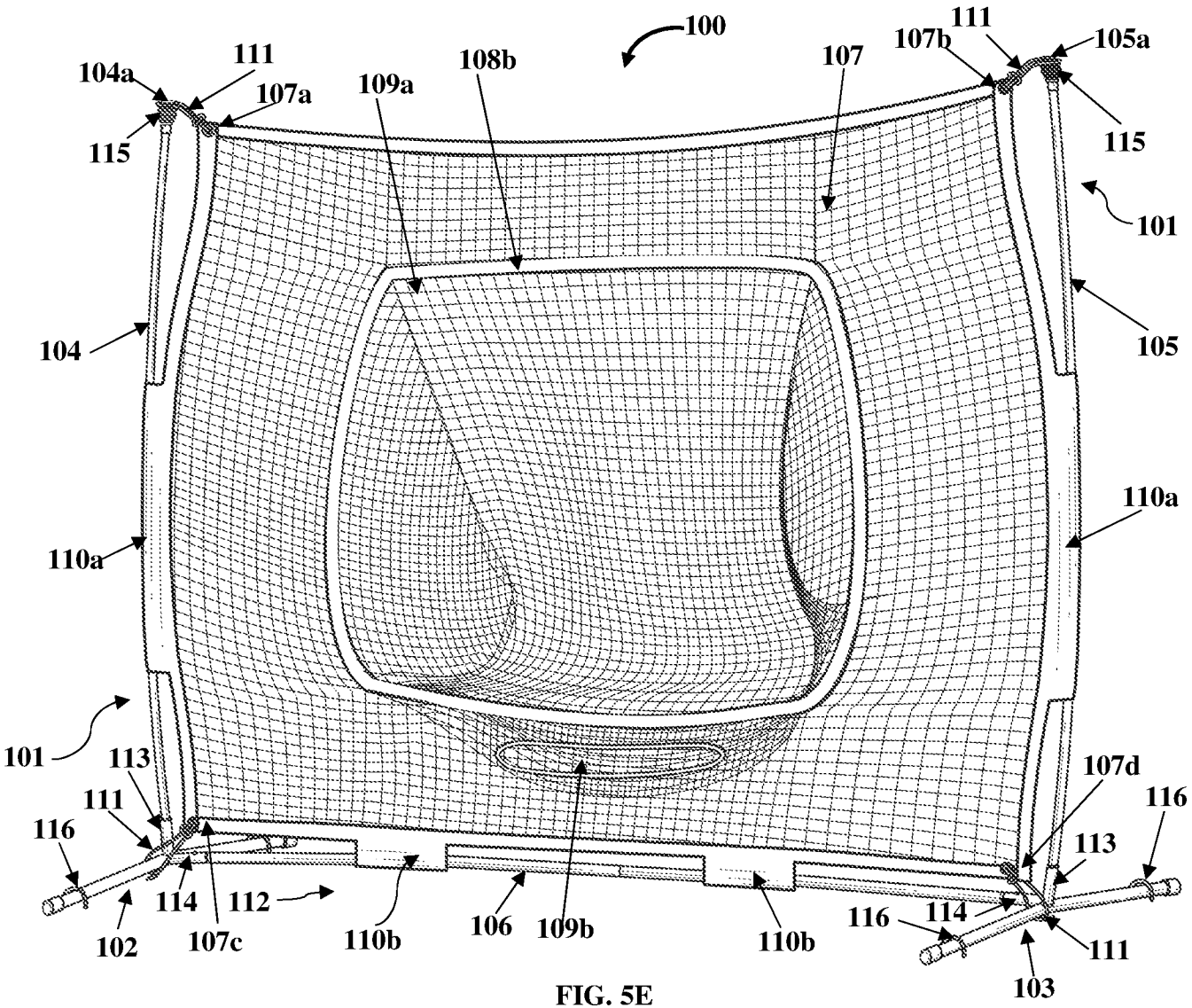

The net 107 of the portable training apparatus 100 is releasably secured to the pair of vertical poles 104 and 105 and the horizontal pole 106 of the collapsible frame 101. The net 107 is releasably secured to opposing ends 104*a*, 104*b* and 105*a*, 105*b* of the vertical poles 104 and 105, respectively, using fastening elements, for example, ties or cords 111, as illustrated in FIGS. 5C-5E. That is, four corners 107*a*, 107*c* and 107*b*, 107*d* of the net 107 are hooked or tied to the ends 104*a*, 104*b* and 105*a*, 105*b* of the vertical poles 104 and 105, respectively, using fastening elements, for example, ties or cords 111. In an embodiment, the net 107 comprises attachment elements 110*a* and 110*b* extending from sides 107*f* and 107*g* and a bottom edge 107*e* of the net 107, respectively, as illustrated in FIGS. 5B-5D. The attachment elements 110*a* and 110*b* are used for securing the net 107 to the vertical poles 104 and 105 and the horizontal pole 106 of the collapsible frame 101 as illustrated in FIGS. 5B-5E. The net 107 is secured to the collapsible frame 101 and is configured to arrest motion of a sporting projectile 301, for example, a ball, a golf disc, or another flying disc, as illustrated in FIGS. 3A-3B. The net 107 comprises one or more pockets 108 built into the net 107. For example, the net 107 comprises three pockets 108*a*, 108*b*, and 108*c* built into the net 107 as illustrated in FIG. 1. In other embodiments, the portable training apparatus 100 comprises nets 107 of different types, sizes, and dimensions, comprising a different number and types of pockets 108*a*, 108*b*, and 108*c* as illustrated in FIGS. 6A-6E. The nets 107 are configured to be compatible with the collapsible frame 101. In an embodiment, the pockets 108 comprise a pair of outer pockets 108*a* and 108*c* and a center pocket 108*b*. The outer pockets 108*a* and 108*c* are configured to receive a sporting projectile 301 thrown thereto during practicing of disc golf drives and approach shots. The center pocket 108*b* is configured to receive the sporting projectile 301 thrown thereto during practicing of putts. The center pocket 108*b* and the pair of outer pockets 108*a* and 108*c* are configured with multiple different dimensions. The pockets 108*a*, 108*b*, and 108*c* are configured to retain the sporting projectile 301.

In an embodiment as illustrated in FIG. 1, each of the pockets 108*a*, 108*b*, and 108*c* comprises a top opening 109*a* and a bottom opening 109*b* integrated into the net 107. The top opening 109*a* of each of the pockets 108*a*, 108*b*, and 108*c* is configured as a target to receive the sporting projectile 301. The bottom opening 109*b* of each of the pockets 108*a*, 108*b*, and 108*c* is configured to allow easy retrieval and removal of the sporting projectile 301. In an embodiment, the top opening 109*a* of each of the pockets 108*a*, 108*b*, and 108*c* is substantially larger than the bottom opening 109*b* of each of the pockets 108*a*, 108*b*, and 108*c*. The top opening 109*a* of each of the pockets 108*a*, 108*b*, and 108*c* is, for example, of one of a circular shape, a generally rectangular shape, a generally square shape, a polygonal shape, and an elliptical shape. The bottom opening 109*b* of each of the pockets 108*a*, 108*b*, and 108*c* is, for example, of one of a slit shape, a circular shape, a polygonal shape, and an elliptical shape. In an embodiment, the pockets 108*a*, 108*b*, and 108*c* are configured to direct the sporting projectile 301 towards the bottom opening 109*b* of a corresponding one of the pockets 108*a*, 108*b*, and 108*c* after the sporting projectile 301 enters the corresponding one of the pockets 108*a*, 108*b*, and 108*c* from the top opening 109*a* of the corresponding one of the pockets 108*a*, 108*b*, and 108*c*. In an embodiment, the bottom opening 109*b* of the corresponding one of the pockets 108*a*, 108*b*, and 108*c* is disposed proximal to the support surface 112. In an embodiment, each of the one or more pockets 108*a*, 108*b*, and 108*c* comprises a loose netting return channel 109*c* defined between the top opening 109*a* and the bottom opening 109*b*. The loose netting return channel 109*c* comprises a bottom surface 118 below the bottom opening 109*b*, as shown in FIGS. 1, 2 and 3A-3B. The bottom surface 118 is in contact with the support surface 112. The sporting projectile 301 that enters the corresponding one of the pockets 108*a*, 108*b*, and 108*c* is directed to rest on the support surface 112 to prevent snagging of the net 107. In an embodiment, the sporting projectiles 301 entering the loose netting return channel 109*c* of the pockets 108*a*, 108*b*, and 108*c* accumulate at the bottom surface 118 of the loose netting return channel 109*c* of the corresponding pockets 108*a*, 108*b*, and/or 108*c*.

In an embodiment, each of the pockets 108*a*, 108*b*, and 108*c* of the net 107 further comprises a return channel 109*c* defined between the top opening 109*a* and the bottom opening 109*b* of each of the pockets 108*a*, 108*b*, and 108*c* for receiving, retaining, and directing the sporting projectile 301 towards the bottom opening 109*b* of a corresponding pocket 108*a*, 108*b*, or 108*c* to rest on the support surface 112, after the sporting projectile 301 enters the corresponding pocket 108*a*, 108*b*, or 108*c* from the top opening 109*a* of the corresponding pocket 108*a*, 108*b*, or 108*c*, for retrieval and removal of the sporting projectile 301, thereby precluding sagging of the net 107 due to weight of multiple sporting projectiles 301 piled within each of the pockets 108*a*, 108*b*, and 108*c*. The return channel 109*c* funnels the sporting projectiles 301 and allows the sporting projectiles 301 to be removed out of each of the pockets 108*a*, 108*b*, and 108*c* and returned to a user for subsequent throws.

The portable training apparatus 100 is configured for training users, for example, players who play flying disc sports such as disc golf, also referred to as disc golfers. The portable training apparatus 100 is used, for example, by disc golfers, for practicing disc golf drives, approach shots, and putts by throwing sporting projectiles 301, for example, flying discs or golf discs towards the target pockets 108 built into the net 107. The net 107 of the portable training apparatus 100, for example, serves as a disc golf driving and approach practice net with target pockets 108. A user may throw the sporting projectile 301 towards any one of the pockets 108*a*, 108*b*, and 108*c* in the net 107. The top openings 109*a* of the pockets 108*a*, 108*b*, and 108*c* in the net 107 serve as targets configured to catch the sporting projectiles 301. When a user throws the sporting projectile 301 at the top opening 109*a* of any one of the pockets 108*a*, 108*b*, and 108*c*, the sporting projectile 301 passes through the top opening 109*a*, travels easily into and through the return channel 109*c* of the corresponding pocket 108*a*, 108*b*, or 108*c*, and rests on the support surface 112 proximal to the bottom opening 109*b* of the corresponding pocket 108*a*, 108*b*, or 108*c*. The pockets 108*a*, 108*b*, and 108*c* retain the sporting projectiles 301, until the sporting projectiles 301 are removed by a user. The user may remove the sporting projectiles 301 through the respective bottom openings 109*b* of the pockets 108*a*, 108*b*, and 108*c*, by merely pulling the pockets 108*a*, 108*b*, and 108*c* upwards, which causes the sporting projectiles 301 to slide or roll out of the respective bottom openings 109*b*. The bottom opening 109*b* of each of the pockets 108*a*, 108*b*, and 108*c*, therefore, negates the need for the user to bend and remove the sporting projectiles 301 from the pockets 108*a*, 108*b*, and 108*c* during training. The collapsible frame 101 and the net 107 of the portable training apparatus 100 are configured for storage and transportation in a bag, for example, a fabric bag.

Figure 2:
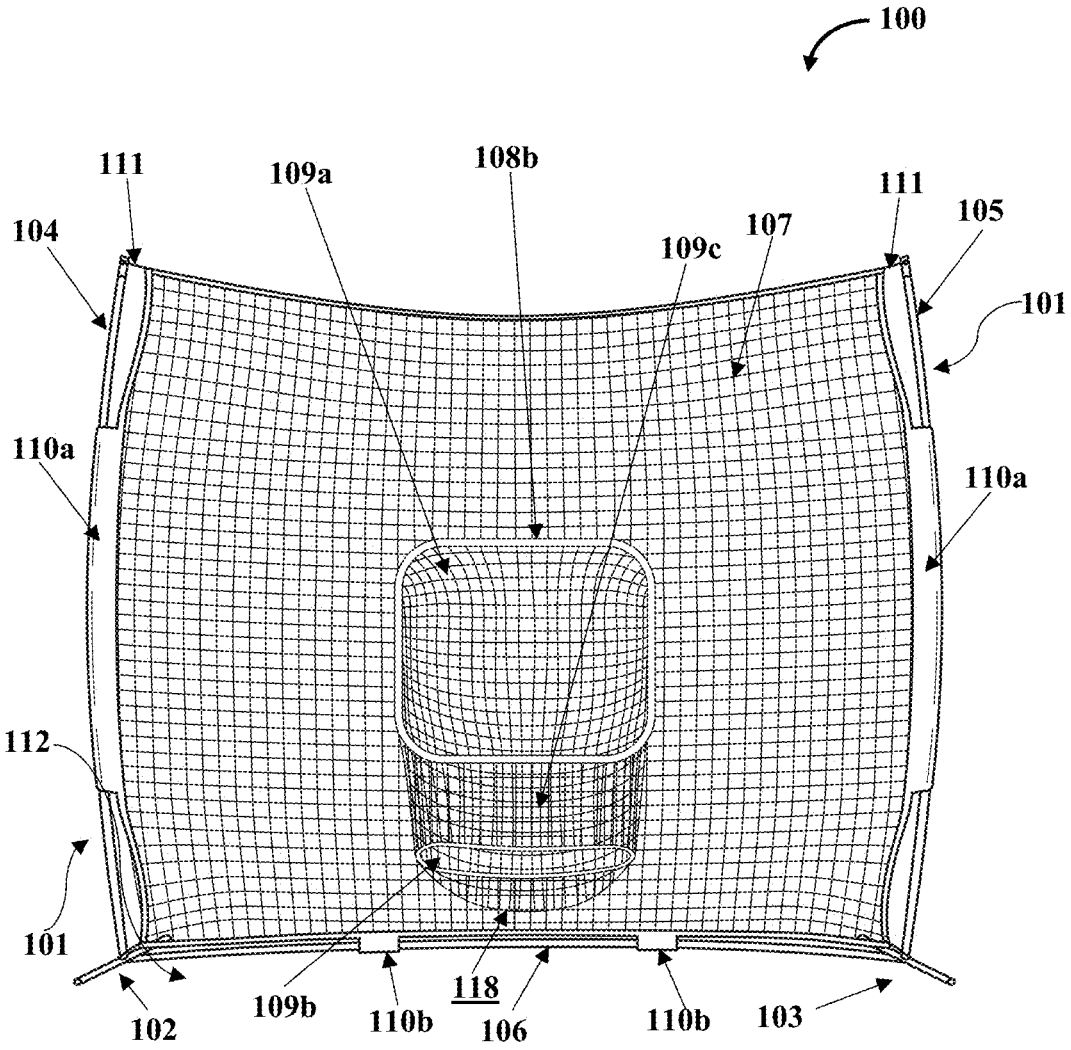
FIG. 2 illustrates a front view of an embodiment of the portable training apparatus comprising a collapsible frame and a net with a single pocket built into the net, where the single pocket comprises a top opening and a bottom opening integrated into the net.

FIG. 2 illustrates a front view of an embodiment of the portable training apparatus 100 comprising a collapsible frame 101 and a net 107 with a single pocket 108*b* built into the net 107, where the single pocket 108*b* comprises a top opening 109*a* and a bottom opening 109*b* integrated into the net 107. The collapsible frame 101 illustrated in FIG. 2 is configured for a portable training apparatus 100 of size, for example, 10 feet wide×10 feet high. As illustrated in FIG. 2, the net 107 is releasably secured to the vertical poles 104 and 105 and the horizontal pole 106 of the collapsible frame 101 as disclosed in the description of FIG. 1. The single pocket 108*b* is located centrally in the net 107. The single pocket 108*b* is configured to receive and retain a sporting projectile 301, for example, a disc, a ball, etc., as illustrated in FIGS. 3A-3B. The top opening 109*a* of the pocket 108*b* is configured to receive the sporting projectile 301. The bottom opening 109*b* of the pocket 108*b* is configured to allow removal of the sporting projectile 301. In an embodiment, the pocket 108*b* further comprises a return channel 109*c* defined between the top opening 109*a* and the bottom opening 109*b* of the pocket 108*b* for receiving, retaining, and directing the sporting projectile 301 towards the bottom opening 109*b* of the pocket 108*b* to rest on the support surface 112, after the sporting projectile 301 enters the pocket 108*b* from the top opening 109*a* of the pocket 108*b*, for retrieval and removal of the sporting projectile 301, thereby precluding sagging of the net 107 due to weight of multiple sporting projectiles 301 piled within the pocket 108*b*.

FIG. 3A illustrates an enlarged view of a pocket 108*b* built into the net 107 of the portable training apparatus 100 shown in FIG. 1, showing multiple sporting projectiles 301 retained within the pocket 108*b*, proximal to the bottom opening 109*b* of the pocket 108*b*. FIG. 3A illustrates the sporting projectiles 301 resting proximal to the bottom opening 109*b* of the pocket 108*b* towards the end of the loose return channel 109*c*, after going through the top opening 109*a* and into the return channel 109*c* of the pocket 108*b*. The loose return channel 109*c* funnels the sporting projectiles 301 and makes the sporting projectiles 301 rest on a support surface 112, for example, a ground surface, as illustrated in FIG. 3B, to reduce sagging of the net 107 due to the weight of the sporting projectiles 301. A user may retrieve and remove the sporting projectiles 301 caught within the pocket 108*b* during various throws, for example, disc golf drives, approach shots, and putts, through the bottom opening 109*b* of the pocket 108*b* integrated into the net 107.

FIG. 3B illustrates a partial side perspective view of the net 107 of the portable training apparatus 100 shown in FIG. 1, showing multiple sporting projectiles 301 funneled by the return channel 109*c* of a pocket 108*b* built into the net 107, to rest on a support surface 112, for example, a ground surface, proximal to the bottom opening 109*b* of the pocket 108*b*. When a user throws multiple sporting projectiles 301 that hit the target pocket 108*b*, the return channel 109*c*, that is configured as a loose netting channel, funnels the received sporting projectiles 301 towards the support surface 112 and makes the received sporting projectiles 301 rest on the support surface 112 as illustrated in FIG. 3B, to preclude the net 107 from sagging due to the weight of the received sporting projectiles 301. The sporting projectiles 301 can be easily retrieved through the bottom opening 109*b* of the pocket 108*b* by merely pulling the pocket 108*b* upwards, which causes the sporting projectiles 301 to slide or roll out of the bottom opening 109*b* of the pocket 108*b*. The bottom opening 109*b* of the pocket 108*b*, therefore, negates the need for the user to bend and retrieve the sporting projectiles 301 when the sporting projectiles 301 are piled in the pocket 108*b*. In an embodiment, the pocket 108*b* does not slack below the bottom opening 109*b*, thereby allowing the sporting projectiles 301 to easily slide out of the bottom opening 109*b*.

Figure 4A:
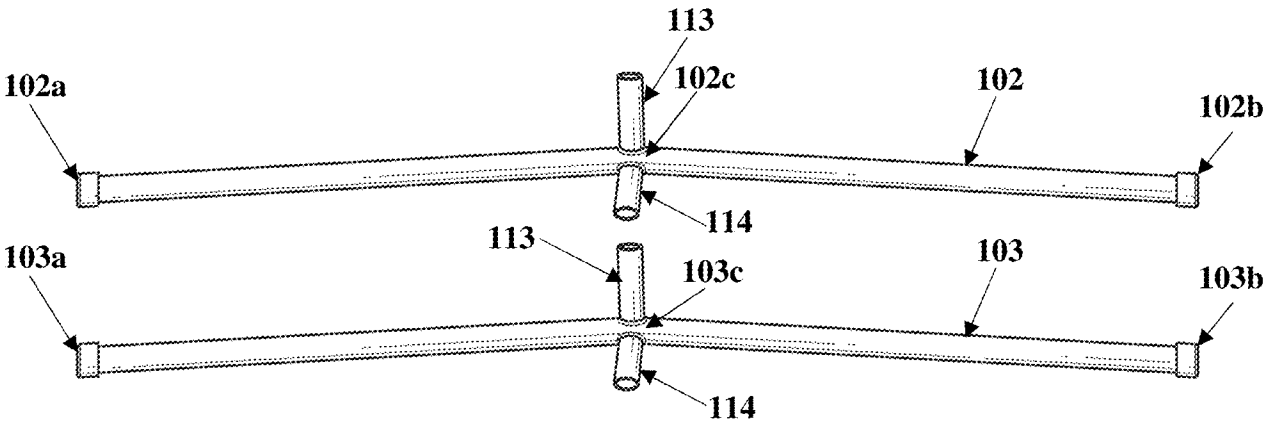
FIG. 4A illustrates an embodiment of a pair of base supports of the collapsible frame of the portable training apparatus.

FIG. 4A illustrates an embodiment of the pair of base supports 102 and 103 of the collapsible frame 101 of the portable training apparatus 100 shown in FIGS. 1-2. In an embodiment, each of the pair of base supports 102 and 103 is of a generally V-shape as illustrated in FIG. 4A. For example, the base support 102 comprises a first end 102*a* and a second end 102*b*, where a first arm of the V-shape that extends from the first end 102*a* and a second arm of the V-shape that extends from the second end 102*b* coincide at a vertex or a mid-section 102*c*. Similarly, the other base support 103 comprises a first end 103*a* and a second end 103*b*, where a first arm of the V-shape that extends from the first end 103*a* and a second arm of the V-shape that extends from the second end 103*b* coincide at a vertex or a mid-section 103*c*. The mid-sections 102*c* and 103*c* of the pair of base supports 102 and 103, respectively, correspond to a vertex or a base of the generally V-shape. The mid-sections 102*c* and 103*c* of the pair of base supports 102 and 103, respectively, face each other when the collapsible frame 101 is assembled and placed on a support surface 112 as illustrated in FIGS. 1-2. In an embodiment as illustrated in FIG. 4A, each of the mid-sections 102*c* and 103*c* of the pair of base supports 102 and 103, respectively, comprises a vertical holder 113 and a horizontal holder 114. The horizontal holder 114 is disposed substantially perpendicular to the vertical holder 113. The vertical holder 113 is configured to secure one of the pair of vertical poles 104 and 105 illustrated in FIG. 4B, of the collapsible frame 101. For example, the vertical holder 113 of the base support 102 is configured to secure the vertical pole 104 illustrated in FIGS. 1-2, FIG. 4B, and FIG. 5E, while the vertical holder 113 of the base support 103 is configured to secure the vertical pole 105 illustrated in FIG. 4B, FIG. 5A, and FIGS. 5C-5E. The horizontal holder 114 is configured to secure one end of the horizontal pole 106 of the collapsible frame 101. For example, one end 106*c* of the horizontal pole 106 is secured to the horizontal holder 114 of the base support 102, and the other end 106*f* of the horizontal pole 106 is secured to the horizontal holder 114 of the base support 103 as illustrated in FIG. 5A.

Figure 4B:
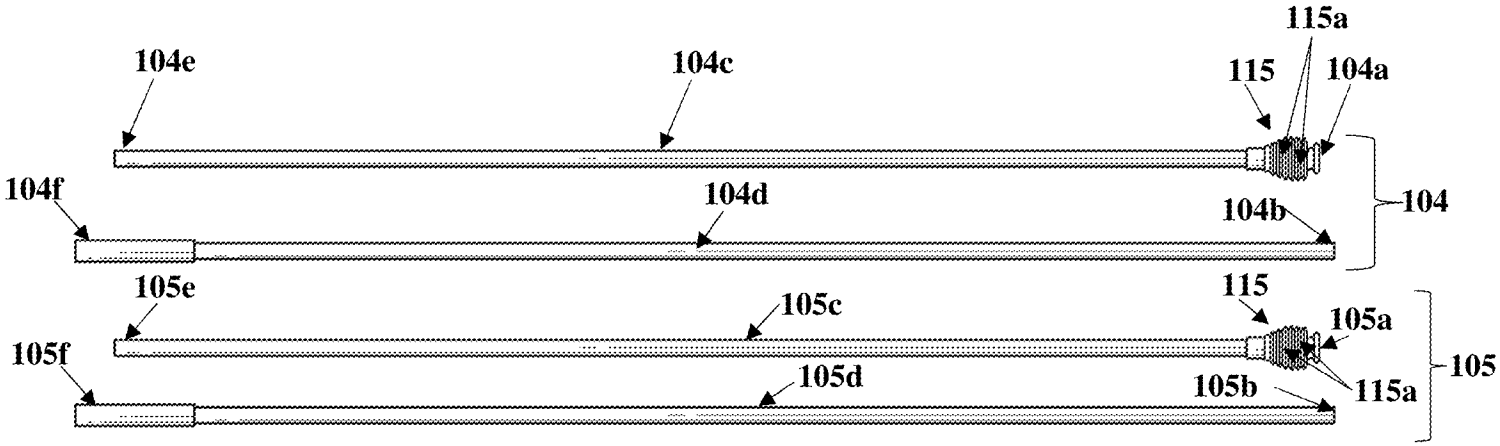
FIG. 4B illustrates an embodiment of a pair of vertical poles of the collapsible frame of the portable training apparatus.

FIG. 4B illustrates an embodiment of the pair of vertical poles 104 and 105 of the collapsible frame 101 of the portable training apparatus 100 shown in FIGS. 1-2. In an embodiment, each of the pair of vertical poles 104 and 105 comprises at least two poles detachably attachable to each other and configured to span a height of the net 107 illustrated in FIGS. 1-2. For example, the vertical pole 104 comprises an upper pole 104*c* and a lower pole 104*d*, and the other vertical pole 105 comprises an upper pole 105*c* and a lower pole 105*d*. The upper poles 104*c* and 105*c* of the vertical poles 104 and 105, respectively, comprise upper ends 104*a* and 105*a* and lower ends 104*e* and 105*e*, respectively. The lower poles 104*d* and 105*d* of the vertical poles 104 and 105, respectively, comprise upper ends 104*f* and 105*f* and lower ends 104*b* and 105*b*, respectively. The lower end 105*e* of the upper pole 105*c* of the vertical pole 105 is configured to be connected and secured to the upper end 105*f* of the lower pole 105*d* of the vertical pole 105 as illustrated in FIG. 5A and FIG. 5C. Similarly, the lower end 104*e* of the upper pole 104*c* of the vertical pole 104 is configured to be connected and secured to the upper end 104*f* of the lower pole 104*d* of the vertical pole 104.

Figure 6A:
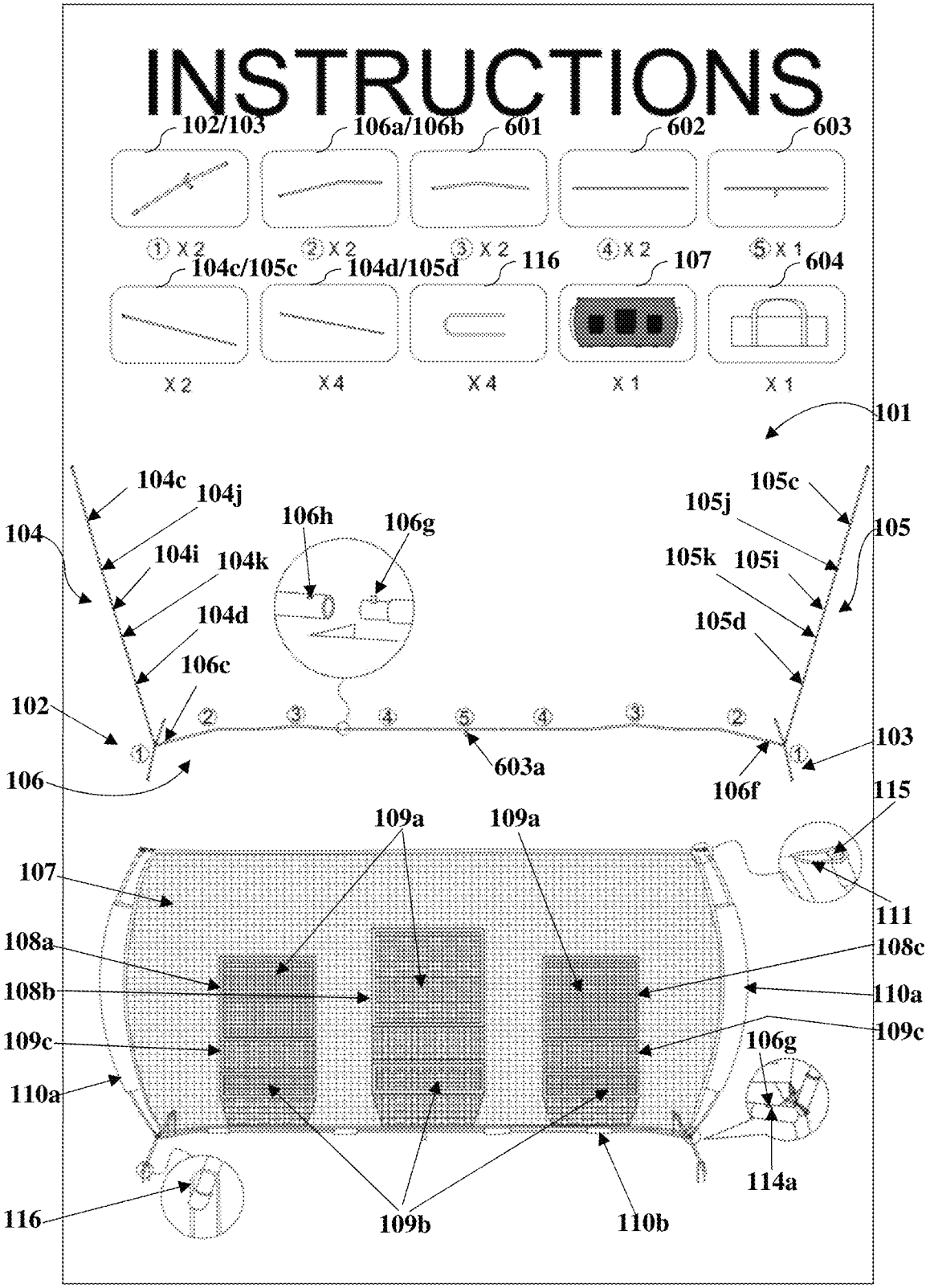
FIGS. 6A-6E illustrate exemplary instruction lists comprising constituent parts of different embodiments of the portable training apparatus with a fabric bag to be delivered to a user, when the user places an order for the portable training apparatus.
Figure 6B:
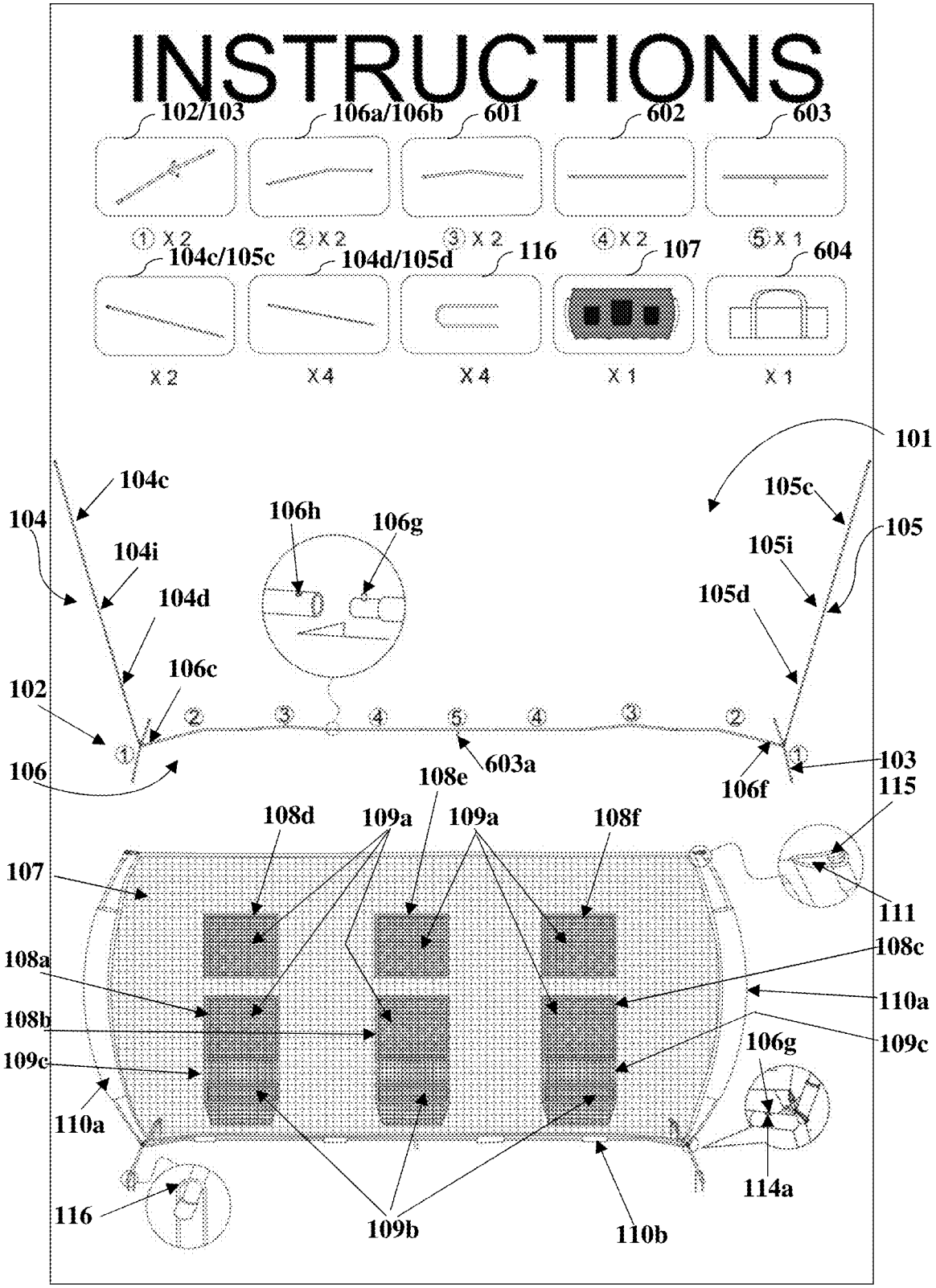
Figure 6C:
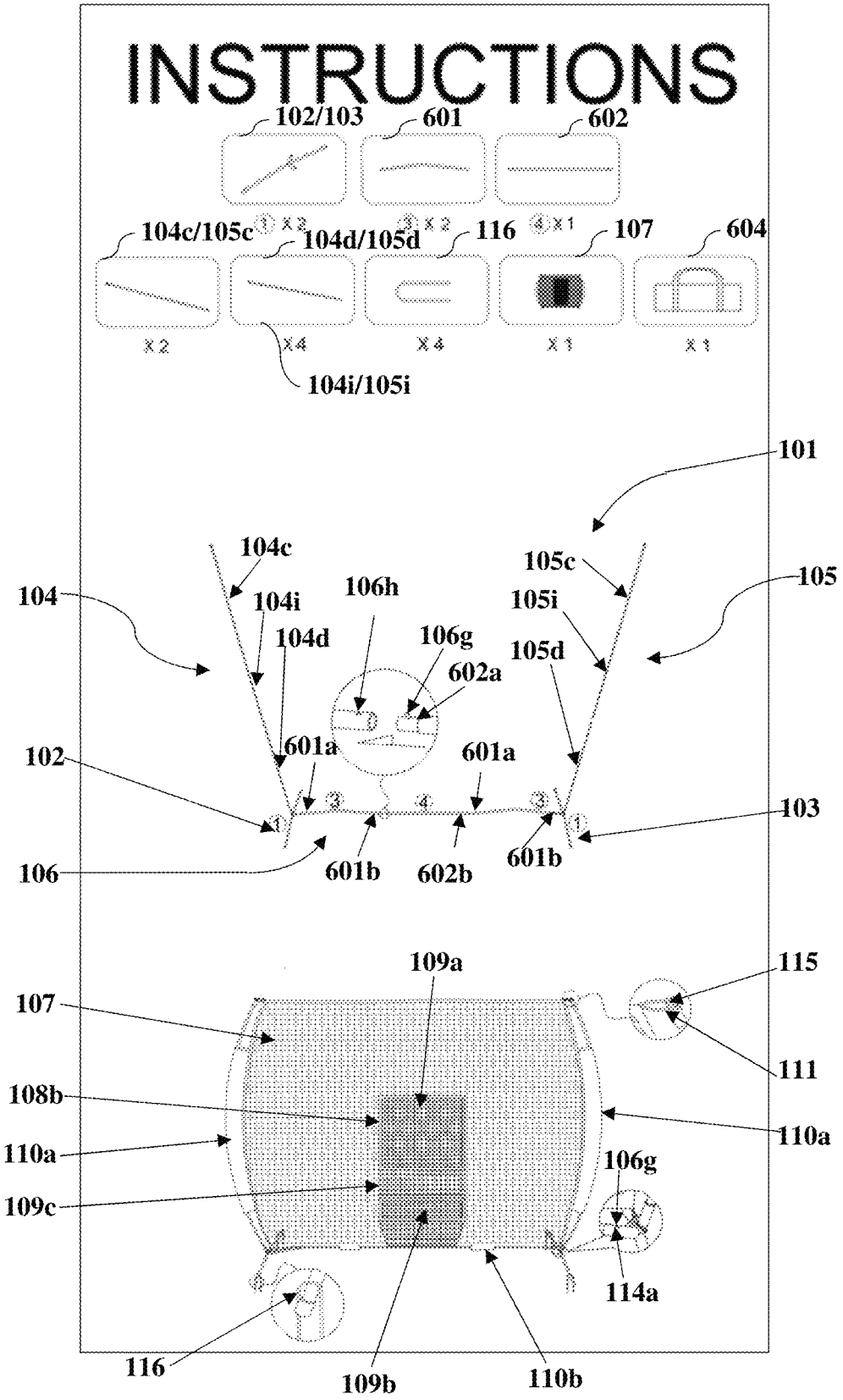

In other embodiments, each of the vertical poles 104 and 105 is built from more than two poles as illustrated in FIGS. 6A-6C. For example, as illustrated in FIGS. 6A-6C, each of the vertical poles 104 and 105 comprise upper poles 104*c* and 105*c*, lower poles 104*d* and 105*d*, and intermediate poles 104*i* and 105*i*. The intermediate poles 104*i* and 105*i* are similar in shape, structure and length as that of the lower poles 104*d* and 105*d*. Each of the intermediate poles 104*i* and 105*i* comprise upper ends 104*j* and 105*j*, and lower ends 104*k* and 105*k*, as illustrated in FIG. 6A. The lower end 104*k* of the intermediate pole 104*i* of the vertical pole 104 is configured to be connected and secured to the upper end 104*f* of the lower pole 104*d*, and the upper end 104*j* of the intermediate pole 104*i* of the vertical pole 104 is configured to be connected and secured to the lower end 104*e* of the upper pole 104*c*. Similarly, the lower end 105*k* of the intermediate pole 105*i* of the vertical pole 105 is configured to be connected and secured to the upper end 105*f* of the lower pole 105*d*, and the upper end 105*j* of the intermediate pole 105*i* of the vertical pole 105 is configured to be connected and secured to the lower end 105*e* of the upper pole 105*c*.

In another embodiment, each of the pair of vertical poles 104 and 105 is configured as a single telescopic pole as illustrated in FIGS. 7A-7B, FIGS. 8A-8B, and FIGS. 10A-

10B, the height of which is configured to be telescopically adjusted, that is, increased or decreased, to fit the size of the net 107.

In an embodiment, the portable training apparatus 100 further comprises a knob 115 affixed to each of the upper ends 104*a* and 105*a* of the vertical poles 104 and 105, respectively. In an embodiment, the knob 115 of each of the vertical poles 104 and 105 is in the shape of a top. In an embodiment, the knob 115 of each of the vertical poles 104 and 105 comprises multiple circumferential grooves 115*a* defined along a length of the knob 115. The circumferential grooves 115*a* are configured to secure the net 107 to the vertical poles 104 and 105 using fastening elements, for example, ties or cords 111, as illustrated in FIGS. 5C-5E. A user may tie opposing, upper corners 107*a* and 107*b* of the net 107 to the knobs 115 at the ends 104*a* and 105*a* of the pair of vertical poles 104 and 105, respectively, for securing the net 107 to the collapsible frame 101.

Figure 4C:
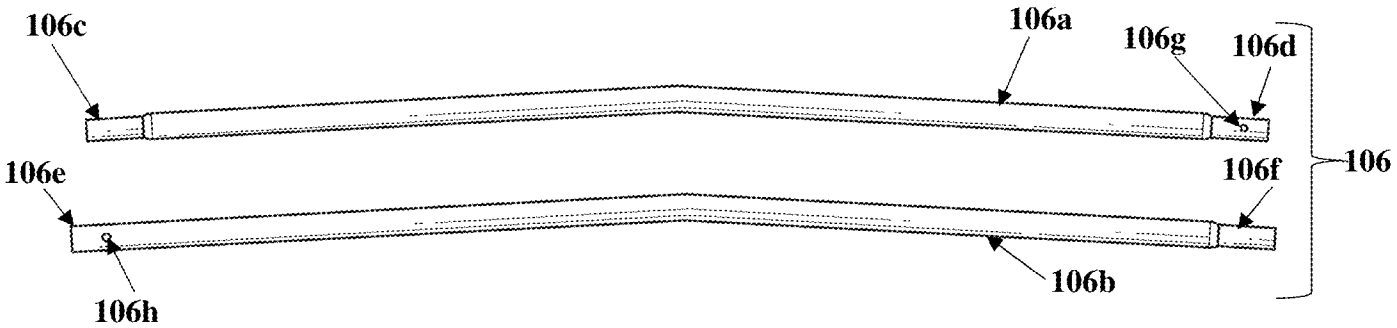
FIG. 4C illustrates an embodiment of a horizontal pole of the collapsible frame of the portable training apparatus.

FIG. 4C illustrates an embodiment of the horizontal pole 106 of the collapsible frame 101 of the portable training apparatus 100 shown in FIGS. 1-2. The horizontal pole 106 is configured to have different lengths corresponding to the width of the net 107 illustrated in FIGS. 1-2. In an embodiment, the horizontal pole 106 comprises at least two poles comprising a first pole 106*a* and a second pole 106*b* detachably attachable to each other and configured to span a width of the net 107 illustrated in FIGS. 1-2. In other embodiments, the horizontal pole 106 is built from more than two poles as illustrated in FIGS. 6A-6C and FIG. 6E. In other embodiments, the horizontal pole 106 is built from poles of different types, for example, angled or generally V-shaped poles, linear poles, etc., as illustrated in FIGS. 6A-6E. Therefore, the horizontal pole 106 is composed of any number and combination of poles of the same and/or different types. In another embodiment, the horizontal pole 106 is configured as a single telescopic pole as illustrated in FIGS. 9A-9C and FIGS. 10A-10B, the width of which is configured to be telescopically adjusted, that is, increased or decreased, to fit the size of the net 107. The first pole 106*a* comprises a first end 106*c* and a second end 106*d*. The second pole 106*b* also comprises a first end 106*e* and a second end 106*f*. The first end 106*c* of the first pole 106*a* is configured to be connected and secured to the horizontal holder 114 of the base support 102, and the second end 106*d* of the first pole 106*a* is configured to be connected and secured to the first end 106*e* of the second pole 106*b* as illustrated in FIG. 5A. Similarly, the second end 106*f* of the second pole 106*b* is configured to be connected and secured to the horizontal holder 114 of the other base support 103 as illustrated in FIG. 5A. In an embodiment, the first pole 106*a* is locked to the second pole 106*b* using a spring-loaded device, for example, a ball plunger, configured on the second end 106*d* of the first pole 106*a* as disclosed in the description of FIG. 5A. In this embodiment, the second end 106*d* of the first pole 106*a* comprises a ball 106*g* of the ball plunger configured to engage with a hole 106*h* configured at the first end 106*e* of the second pole 106*b* for locking the first pole 106*a* to the second pole 106*b*. Similarly, the first end 106*c* of the first pole 106*a* and the second end 106*f* of the second pole 106*b* are connected and secured to the horizontal holders 114 of the base supports 102 and 103, respectively, as disclosed in the description of FIG. 5A.

Figure 4D:
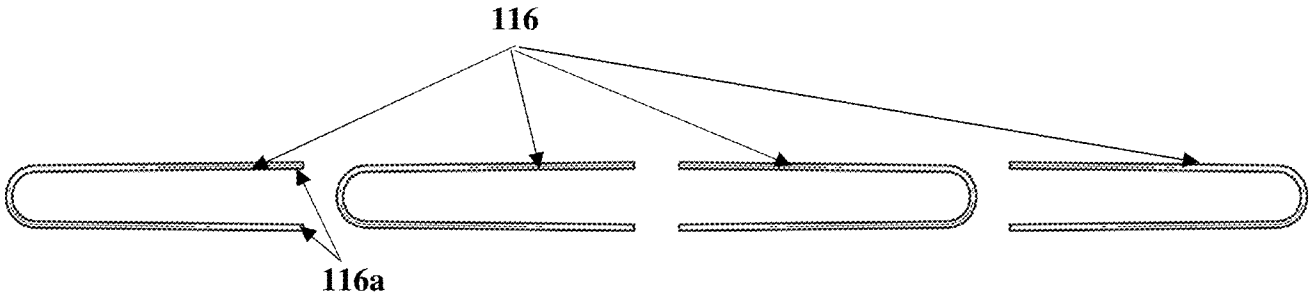
FIG. 4D illustrates an embodiment of fastening elements configured to secure the collapsible frame of the portable training apparatus to a support surface.

FIG. 4D illustrates an embodiment of fastening elements configured to secure the collapsible frame 101 of the portable training apparatus 100 to a support surface 112 shown in FIG. 5E. In an embodiment, the portable training apparatus 100 further comprises multiple U-shaped stakes 116 configured as fastening elements to secure the pair of base supports 102 and 103 and the horizontal pole 106 of the collapsible frame 101 to the support surface 112 as illustrated in FIG. 5A and FIGS. 5C-5E. The U-shaped stakes 116 are, for example, metal posts with pointed ends 116*a* configured to be driven into the support surface 112 for securing and supporting the collapsible frame 101 and in turn, the portable training apparatus 100, on the support surface 112. In an embodiment, sand bags (not shown) are used for securing and supporting the collapsible frame 101 and in turn, the portable training apparatus 100, on the support surface 112.

FIGS. 5A-5E illustrates an embodiment of a method for assembling the portable training apparatus 100 shown in FIG. 5E. FIG. 5A illustrates an embodiment of a method for assembling the collapsible frame 101 of the portable training apparatus 100. As illustrated in FIG. 5A, the pair of base supports 102 and 103 of the collapsible frame 101 are disposed on a support surface 112, for example, a ground surface, and distanced apart such that the horizontal holders 114 of the base supports 102 and 103 face each other. The horizontal pole 106 of the collapsible frame 101 is assembled by connecting and securing one end 106*d* of the first pole 106*a* to one end 106*e* of the second pole 106*b*. In an embodiment, one end 106*d* of the first pole 106*a* is connected to one end 106*e* of the second pole 106*b* by a snap-fit connection. The other end 106*c* of the first pole 106*a* is inserted into the horizontal holder 114 of the base support 102. In an embodiment, the other end 106*c* of the first pole 106*a* is connected to the horizontal holder 114 of the base support 102 by a snap-fit connection. Similarly, the other end 106*f* of the second pole 106*b* is inserted into the horizontal holder 114 of the base support 103. In an embodiment, the other end 106*f* of the second pole 106*b* is connected to the horizontal holder 114 of the base support 103 by a snap-fit connection.

In an embodiment as illustrated in FIG. 5A, the ends 106*c* and 106*f* of the first pole 106*a* and the second pole 106*b*, respectively, comprise spring-loaded devices, for example, ball plungers, for locking the first pole 106*a* and the second pole 106*b* to the horizontal holders 114 of the base supports 102 and 103, respectively. Similarly, the end 106*d* of the first pole 106*a* also comprises a spring-loaded device, for example, a ball plunger, for locking the first pole 106*a* and the second pole 106*b* to each other. In the process of connecting the end 106*d* of the first pole 106*a* to the end 106*e* of the second pole 106*b*, when pressure is applied to the ball 106*g* of the ball plunger at the end 106*d* of the first pole 106*a*, the ball 106*g* begins to sink down and compress a spring (not shown) that is enclosed within the body of the ball plunger. As pressure begins to release, the built-up force from the spring causes the ball 106*g* at the end 106*d* of the first pole 106*a* to be pushed upwards to its original position, causing the ball 106*g* to emerge out of the hole 106*h* in the end 106*e* of the second pole 106*b*. Similarly, in the process of connecting the ends 106*c* and 106*f* of the first pole 106*a* and the second pole 106*b*, respectively, to the horizontal holders 114 of the base supports 102 and 103, respectively, when pressure is applied to the ball 106*g* of the ball plunger at each of the ends 106*c* and 106*f* of the first pole 106*a* and the second pole 106*b*, respectively, the ball 106*g* begins to sink down and compress a spring that is enclosed within the body of the ball plunger. As pressure begins to release, the built-up force from the spring causes the ball 106*g* at each of the ends 106*c* and 106*f* of the first pole 106*a* and the second pole 106*b*, respectively, to be pushed upwards to its original position, causing the ball 106*g* to emerge out of the hole 114*a* in each of the horizontal holders 114 of the base supports 102 and 103, respectively. In an embodiment, the pair of base supports 102 and 103 are optionally secured to the support surface 112 using multiple U-shaped stakes 116 as illustrated in FIG. 5A. The U-shaped stakes 116 are disposed over the base supports 102 and 103 and their pointed ends 116*a* are driven into the support surface 112 for securing the base supports 102 and 103 and in turn, the collapsible frame 101, to the support surface 112.

Furthermore, the lower poles 104*d* and 105*d* of the pair of vertical poles 104 and 105, respectively, illustrated in FIG. 4B, are inserted into the vertical holders 113 of the pair of base supports 102 and 103, respectively. For example, the lower end 105*b* of the lower pole 105*d* is inserted into the vertical holder 113 of the base support 103 as illustrated in FIG. 5A. In an embodiment, the lower ends 104*b* and 105*b* of the lower poles 104*d* and 105*d,* respectively, are inserted into the vertical holders 113 of the base supports 102 and 103, respectively, by a snap-fit connection. In an embodiment, the lower ends 104*e* and 105*e* of the upper poles 104*c* and 105*c,* respectively, illustrated in FIG. 4B, are then connected and secured to the upper ends 104*f* and 105*f* of the lower poles 104*d* and 105*d,* respectively, for example, by a snap-fit connection.

FIG. 5B illustrates an embodiment of a method for attaching a bottom attachment element 110*b* of the net 107 to the horizontal pole 106 of the collapsible frame 101. In an embodiment as illustrated in FIG. 5B, the bottom attachment element 110*b* of the net 107 is configured as a flap and attached to the horizontal pole 106 of the collapsible frame 101 using a hook and loop fastener 117, for example, a Velcro® fastener. The hook and loop fastener 117 comprises two fabric strips 117*a* and 117*b* attached to opposing sides 110*c* and 110*d* of the bottom attachment element 110*b*. In an embodiment, the fabric strip 117*a* on one side 110*c* of the bottom attachment element 110*b* comprises loops of the hook and loop fastener 117, while the fabric strip 117*b* on the other side 110*d* of the bottom attachment element 110*b* comprises hooks of the hook and loop fastener 117 as illustrated in FIG. 5B. In another embodiment, the hooks and the loops of the hook and loop fastener 117 are interchangeably configured on the fabric strips 117*a* and 117*b*. When the bottom attachment element 110*b* encloses the horizontal pole 106 and the fabric strip 117*b* on one side 110*d* of the bottom attachment element 110*b* is pressed against the fabric strip 117*a* on the other side 110*c* of the bottom attachment element 110*b,* the hooks on the fabric strip 117*b* engage the loops on the fabric strip 117*a* for attaching the bottom attachment element 110*b* of the net 107 around the horizontal pole 106.

FIG. 5C illustrates an embodiment of a method for assembling one of the vertical poles, for example, 105, to one of the base supports, for example, 103, of the collapsible frame 101 illustrated in FIG. 5E, and for securing a lateral attachment element 110*a,* for example, a lateral tubing, of the net 107 to the vertical pole 105. In an embodiment, the net 107 comprises lateral attachment elements 110*a* configured, for example, as lateral tubing, on opposing sides 107*f* and 107*g* of the net 107. The lower poles 104*d* and 105*d* of the pair of vertical poles 104 and 105, respectively, illustrated in FIG. 4B, are inserted into the lateral attachment elements 110*a* on both sides 107*f* and 107*g* of the net 107. The lower ends 104*b* and 105*b* of the lower poles 104*d* and 105*d,* respectively, are then inserted and secured into the vertical holders 113 of the base supports 102 and 103, respectively. The lower ends 104*e* and 105*e* of the upper poles 104*c* and 105*c* of the pair of vertical poles 104 and 105, respectively, illustrated in FIG. 4B, are then attached to the upper ends 104*f* and 105*f* of the lower poles 104*d* and 105*d,* respectively. The lateral attachment elements 110*a* on both sides 107*f* and 107*g* of the net 107 are slid over the upper poles 104*c* and 105*c,* respectively, until the upper corners 107*a* and 107*b* of the net 107 are proximal to the knobs 115 at the upper ends 104*a* and 105*a* of the upper poles 104*c* and 105*c,* respectively. The upper corners 107*a* and 107*b* of the net 107 are then secured to the knobs 115, for example, using ties or cords 111 such as bungee cords. The net 107 is suspended from the knobs 115 by the ties or cords 111 on the top and simultaneously secured on the sides 107*f* and 107*g* by the lateral attachment elements 110*a* of the net 107. The bottom attachment element 110*b* configured, for example, as a Velcro® flap, at the bottom edge 107*e* of the net 107 is then secured to the horizontal pole 106 as disclosed in the description of FIG. 5B. In an embodiment, the lower corners 107*c* and 107*d* of the net 107 are also optionally secured to the pair of base supports 102 and 103, respectively, using fastening elements, for example, ties or cords 111, as illustrated in FIG. 5C. Furthermore, the pointed ends 116*a* of the U-shaped stakes 116 are driven into the support surface 112 for securing the base supports 102 and 103 and in turn, the collapsible frame 101, to the support surface 112.

FIG. 5D illustrates an embodiment of the method for securing the bottom edge 107*e* of the net 107 to the horizontal pole 106 of the collapsible frame 101 illustrated in FIG. 5E. In an embodiment, multiple bottom attachment elements 110*b* are configured as tubing at the bottom edge 107*e* of the net 107 through which the horizontal pole 106 is inserted for attaching the bottom edge 107*e* of the net 107 to the horizontal pole 106. The horizontal pole 106 slides through the tubing at the bottom edge 107*e* of the net 107 to secure the net 107 to the horizontal pole 106.

FIG. 5E illustrates an embodiment of the assembled portable training apparatus 100. The collapsible frame 101 comprising the base supports 102 and 103, the pair of vertical poles 104 and 105, and the horizontal pole 106, is assembled and supported by the U-shaped stakes 116 on the support surface 112 as disclosed in the description of FIG. 5A and FIGS. 5C-5D. In an embodiment, the vertical poles 104 and 105 are made of fiberglass. In an embodiment, the horizontal pole 106 is made of metal. In an embodiment, the pair of base supports 102 and 103 are made of metal. In an embodiment, the pair of vertical poles 104 and 105 are convex in shape. In an embodiment, the pair of base supports 102 and 103, the pair of vertical poles 104 and 105, and the horizontal pole 106 are configured in multiple sizes to support nets 107 of different sizes. The net 107 is secured to the collapsible frame 101 by the attachment elements 110*a* and 110*b* and the ties or cords 111 as disclosed in the descriptions of FIGS. 5B-5D. The net 107 is configured in multiple ply and thicknesses. For example, dimensions of the net 107 illustrated in FIG. 5E is 6 feet wide×6 feet high. The net 107 is made, for example, from high-density polyethylene (HDPE), knotless polyester, etc. Also illustrated in FIG. 5E is a single pocket 108*b* built into the net 107 for receiving and retaining a sporting projectile, for example, a golf disc, when a user utilizes the portable training apparatus 100 for practicing disc golf drives, approach shots, and putts.

Exemplary sizes, dimensions, and specifications of the components of the portable training apparatus 100 are disclosed below.

1) Portable training apparatus 100 of size about 22 feet wide×10 feet high:

a) Collapsible frame 101: One metal horizontal pole 106 with a diameter of about 1.25 inches and a total length of about 278 inches; two metal base supports 102 and 103, each with a diameter of about 1.25 inches and a length of about 36 inches; and two vertical poles 104 and 105 made of fiberglass, each with a diameter of about 1.25 inches and a length of about 123 inches;

b) Net 107: 22-ply knotless high-density polyethylene (HDPE) netting with 420 Denier and 900 Denier fabric;

c) Pockets 108: Two 2 feet wide×2 feet high outer pockets 108*a* and 108*c* and one 4 feet wide×4 feet high center pocket 108*b;* and d) 600 Denier fabric carry bag.

2) Portable training apparatus 100 of size about 10 feet wide×10 feet high:

a) Collapsible frame 101: One metal horizontal pole 106 with a diameter of about 1.25 inches and a total length of about 121.75 inches; two metal base supports 102 and 103, each with a diameter of about 1.25 inches and a length of about 36 inches; and two vertical poles 104 and 105 made of fiberglass, each with a diameter of about 1.25 inches and a total length of about 123 inches;

b) Net 107: 5-ply, 2 inch-knotless polyester netting with 420 Denier and 600 Denier fabric;

c) Pockets 108: One 4 feet wide×4 feet high center pocket 108*b;* and d) 600 Denier fabric carry bag.

3) Portable training apparatus 100 of size about 7 feet wide×7 feet high:

a) Collapsible frame 101: One metal horizontal pole 106 with a diameter of about 1.25 inches and a total length of about 81.25 inches, two metal base supports 102 and 103, each with a diameter of about 1.25 inches and a length of about 36 inches; and two vertical poles 104 and 105 made of fiberglass, each with a diameter of about 1.25 inches and a total length of about 81.5 inches;

b) Net 107: 5-ply, 1-inch knotless polyester netting with 420 Denier and 600 Denier fabric;

c) Pockets 108: One 2 feet wide×2 feet high center pocket 108*b;* and d) 600 Denier fabric carry bag.

In another example, the pockets 108 comprise top openings 109*a* ranging from about 1 feet wide×1 feet high to about 4 feet wide×4 feet high. The nets 107 are configured to comprise different pocket configurations and opening sizes. Users have an option to buy the above-disclosed types of portable training apparatuses 100 individually as per their requirement. Alternatively, users may order a two-in-one collapsible frame 101 that is configured for compatibility with both a 22 feet wide net 107 and a 10 feet wide net 107. Exemplary dimensions of the two-in-one collapsible frame 101 are as follows:

Collapsible frame 101: One metal horizontal pole 106 with a diameter of about 1.25 inches and a total length of about 278 inches; two metal base supports 102 and 103, each with a diameter of about 1.25 inches and a length of about 36 inches; and two vertical poles 104 and 105 made of fiberglass, each with a diameter of about 1.25 inches and a length of about 123 inches.

Users may buy the above two-in-one collapsible frame 101 with two types of nets 107. Alternatively, users may first buy the two-in-one collapsible frame 101 and the larger 22 feet wide net 107, and later the 10 feet wide net 107 without the two-in-one collapsible frame 101. Alternatively, users may first buy the two-in-one collapsible frame 101 and the 10 feet wide net 107, and later upgrade to the 22 feet wide net 107 by purchasing a few extension pieces for the horizontal pole 106. The user may also purchase a few extension pieces for each of the vertical poles 104 and 105 to accommodate nets 107 of different heights. When a user places an order for the portable training apparatus 100, the user receives the portable training apparatus 100 in a disassembled form with constituent parts of the portable training apparatus 100, a fabric bag for storing the constituent parts of the portable training apparatus 100, and a list of instructions on how to assemble the portable training apparatus 100 as illustrated in FIGS. 6A-6E. A collapsible frame 101 of a particular size can be reconfigured to create a collapsible frame 101 of a smaller size than itself. For example, collapsible frames 101 of different sizes, for example, 22 feet wide×10 feet high, 10 feet wide×10 feet high, 10 feet wide×7 feet high, and 7 feet wide×7 feet high can be built using pieces or poles of a 22 feet wide×10 feet high collapsible frame 101. Similarly, collapsible frames 101 of different sizes, for example, 10 feet wide×10 feet high, 10 feet wide×7 feet high, and 7 feet wide×7 feet high can be built using pieces or poles of a 10 feet wide×10 feet high collapsible frame 101. Moreover, collapsible frames 101 of different sizes, for example, 10 feet wide×7 feet high and 7 feet wide×7 feet high can be built using pieces or poles of a 10 feet wide×7 feet high collapsible frame 101. Furthermore, a collapsible frame 101 of size 7 feet wide×7 feet high can be built using pieces or poles of a 7 feet wide×7 feet high collapsible frame 101. The sizes of the nets 107 are selected based on the sizes of the collapsible frames 101. In an embodiment, each net 107 is slightly smaller than the size of the collapsible frame 101 as illustrated in FIGS. 6A-6E. The nets 107 are configured for compatibility with collapsible frames 101 of different sizes. Similarly, the size of the collapsible frame 101 is configurable based on the size of the net 107. Each collapsible frame 101 can be reconfigured to fit the size of the net 107 that is smaller than the collapsible frame 101. The collapsible frame 101 is, therefore, also configured for compatibility with nets 107 of different sizes.

FIGS. 6A-6E illustrate exemplary instruction lists comprising constituent parts of different embodiments of the portable training apparatus 100 with a fabric bag 604 to be delivered to a user, when the user places an order for the portable training apparatus 100. As illustrated in FIG. 6A, the exemplary instruction list comprises constituent parts of an embodiment of the portable training apparatus 100 with a fabric bag 604. In this embodiment, the constituent parts of the portable training apparatus 100 comprise two base supports 102 and 103, constituent parts 106*a,* 106*b,* 601, 602, and 603 of an embodiment of the horizontal pole 106, constituent parts 104*c,* 105*c* and 104*d,* 105*d* of an embodiment of the vertical poles 104 and 105, four U-shaped stakes 116, and one net 107 with three target pockets 108*a,* 108*b,* and 108*c*. Exemplary dimensions of the parts of the portable training apparatus 100 illustrated in FIG. 6A are as follows. The diameter of each of the base supports 102 and 103 is, for example, about 1.25 inches, and the length of each of the base supports 102 and 103 is, for example, about 36 inches. The diameter of each of the constituent parts 106*a,* 106*b,* 601, 602, and 603 of the horizontal pole 106 is, for example, about 1.25 inches. The lengths of the constituent parts 106*a,* 106*b,* 601, 602, and 603 of the horizontal pole 106 are, for example, about 38.5 inches, 38.5 inches, 40.5 inches, 40.75 inches, and 38.5 inches, respectively. The diameter of each of the constituent parts 104*c,* 104*d* and 105*c,* 105*d* of the vertical poles 104 and 105, respectively, is, for example, about 1.25 inches. The length of each of the upper poles 104*c* and 105*c* of the vertical poles 104 and 105, respectively, is, for example, about 40 inches. The length of each of the lower poles 104*d* and 105*d* of the vertical poles 104 and 105, respectively, is, for example, about 41.5 inches.

The exemplary instruction list provides instructions on how to assemble the collapsible frame 101 comprising the base supports 102 and 103, the vertical poles 104 and 105, and the horizontal pole 106. FIG. 6A illustrates assembly of an embodiment of the collapsible frame 101 of size, for example, 22 feet (') wide×10 feet (') high. The 22' wide×10' high collapsible frame 101 is configured to be convertible and compatible with multiple nets 107 of different sizes. For example, using specific pieces or poles of the 22' wide×10' high collapsible frame 101, the 22' wide×10' high collapsible frame 101 can be reconfigured to build collapsible frames 101 of different sizes such as a 10' wide×10' high collapsible frame, 10' wide×7' high collapsible frame, and a 7' wide×7' high collapsible frame to hold and support nets 107 of corresponding sizes. A user may therefore purchase a 22' wide×10' high collapsible frame 101 with multiple nets 107 of sizes, for example, 22'×10', 10'×10', 10'×7', and 7'×7', and interchange their setup according to their training preferences. Similarly, the collapsible frame 101 of each size can be reconfigured to create collapsible frames of sizes smaller than itself as disclosed above. For example, a 10' wide×10' high collapsible frame cannot build a 22' wide×10' high collapsible frame, but can build each collapsible frame smaller than itself apart from its own complete 10' wide×10' high collapsible frame. That is, pieces or poles of the 10' wide×10' high collapsible frame can build collapsible frames of sizes, for example, 10'×10', 10'×7', and 7'×7' to hold nets 107 of sizes 10'×10', 10'×7', and 7'×7', respectively.

In the embodiment of the portable training apparatus 100 illustrated in FIG. 6A, the exemplary instruction list instructs the user to: (1) place the base supports 102 and 103 on a support surface; (2) position the U-shaped stakes 116 over the base supports 102 and 103 and drive the U-shaped stakes 116 into the support surface; (3) connect the constituent parts, that is, the poles 106*a*, 106*b*, 601, 602, and 603, of the horizontal pole 106 to each other as illustrated in FIG. 6A, using, for example, the ball 106*g* and the hole 106*h* connection as disclosed in the description of FIG. 5A; (4) connect distal ends 106*c* and 106*f* of the poles 106*a* and 106*b*, respectively, to the horizontal holders 114 of the base supports 102 and 103, respectively, using, for example, the ball 106*g* and the hole 114*a* connection illustrated in FIG. 5A; (5) connect the constituent parts of the vertical poles 104 and 105, that is, connect the upper poles 104*c*, 105*c* to the lower poles 104*d*, 105*d* of the vertical poles 104 and 105, respectively, as illustrated in FIG. 6A; and then (6) connect lower ends 104*b* and 105*b* of the bottom, lower poles 104*d* and 105*d*, respectively, to the vertical holders 113 of the base supports 102 and 103, respectively, as illustrated in FIG. 5A and FIGS. 5C-5D. In the embodiment of the portable training apparatus 100 illustrated in FIG. 6A, each of the vertical poles 104 and 105 comprises one upper pole 104*c*, 105*c* and two lower poles 104*d*, 105*d*. Furthermore, in this embodiment, the horizontal pole 106 comprises seven poles, that is, two distal, angled or generally V-shaped poles 106*a* and 106*b*, and five intermediate poles, that is, two angled or generally V-shaped poles 601, two linear poles 602, and one pole 603 with a protruding element 603*a*. The protruding element 603*a* of the pole 603 is a small support leg configured to further support the collapsible frame 101, and in turn, the portable training apparatus 100, on the support surface.

The exemplary instruction list further instructs the user to insert the vertical poles 104 and 105 through the lateral attachment elements 110*a*, for example, the lateral tubing, of the net 107 and to secure the bottom attachment elements 110*b* of the net 107 to the horizontal pole 106. In the embodiment of the portable training apparatus 100 illustrated in FIG. 6A, the net 107 comprises three target pockets 108*a*, 108*b*, and 108*c* for catching and retaining sporting projectiles, for example, golf discs, thrown thereto. Each of the pockets 108*a*, 108*b*, and 108*c* comprises a top opening 109*a* of, for example, a generally square shape, and a bottom opening 109*b* of, for example, a generally rectangular shape, for receiving and allowing removal of the sporting projectiles, respectively. Each of the pockets 108*a*, 108*b*, and 108*c* further comprises a return channel 109*c* for directing the received sporting projectiles towards the bottom opening 109*b* of a corresponding pocket 108*a*, 108*b*, or 108*c* to rest on the support surface, thereby precluding sagging of the net 107 due to weight of the sporting projectiles piled within the corresponding pocket 108*a*, 108*b*, or 108*c*. The exemplary instruction list further instructs the user to secure the corners 107*a*, 107*c*, 107*b*, and 107*d* of the net 107 to the ends 104*a*, 104*b* and 105*a*, 105*b* of the vertical poles 104 and 105, respectively, using fastening elements, for example, ties or cords 111, as illustrated in FIG. 1. The ties or cords 111 are tied to the knobs 115 on the upper ends 104*a* and 105*a* of the vertical poles 104 and 105, respectively, and around the base supports 102 and 103 as illustrated in FIGS. 5C-5E.

FIG. 6B illustrates an exemplary instruction list comprising constituent parts of another embodiment of the portable training apparatus 100 with a fabric bag 604. In this embodiment, the constituent parts of the portable training apparatus 100 comprise two base supports 102 and 103, constituent parts 106*a*, 106*b*, 601, 602, and 603 of an embodiment of the horizontal pole 106, constituent parts 104*c*, 105*c* and 104*d*, 105*d* of an embodiment of the vertical poles 104 and 105, four U-shaped stakes 116, and one net 107 with six target pockets 108*a*, 108*b*, 108*c*, 108*d*, 108*e*, and 108*f*. Dimensions of the parts of the portable training apparatus 100 illustrated in FIG. 6B are similar to the exemplary dimensions disclosed in the description of FIG. 6A. In the embodiment of the portable training apparatus 100 illustrated in FIG. 6B, the exemplary instruction list instructs a user to assemble the collapsible frame 101 comprising the base supports 102 and 103, the horizontal pole 106, and the vertical poles 104 and 105 as disclosed in the description of FIG. 6A. FIG. 6B illustrates assembly of another embodiment of the collapsible frame 101 of size, for example, 22 feet wide×10 feet high. The exemplary instruction list further instructs the user to insert the vertical poles 104 and 105 through the lateral attachment elements 110*a*, for example, the lateral tubing, of the net 107 and to secure the bottom attachment elements 110*b* of the net 107 to the horizontal pole 106.

In the embodiment of the portable training apparatus 100 illustrated in FIG. 6B, the net 107 comprises two rows of target pockets 108*a*, 108*b*, 108*c*, 108*d*, 108*e*, and 108*f*, that is, three lower target pockets 108*a*, 108*b*, and 108*c* and three upper target pockets 108*d*, 108*e*, and 108*f*, for catching and retaining sporting projectiles, for example, golf discs, thrown thereto. Each of the pockets 108*a*, 108*b*, 108*c*, 108*d*, 108*e*, and 108*f* comprises a top opening 109*a* of, for example, a generally square shape, and a bottom opening 109*b* of, for example, a generally rectangular shape, for receiving and allowing removal of the sporting projectiles, respectively. Each of the pockets 108*a*, 108*b*, 108*c*, 108*d*, 108*e*, and 108*f* further comprises a return channel 109*c* for directing the received sporting projectiles towards the bottom opening 109*b* of a corresponding pocket 108*a*, 108*b*, 108*c*, 108*d*, 108*e*, or 108*f* to rest on the support surface, thereby precluding sagging of the net 107 due to weight of the sporting projectiles piled within the corresponding pocket 108*a*, 108*b*, 108*c*, 108*d*, 108*e*, or 108*f*. The exemplary instruction list further instructs the user to secure the corners 107*a*, 107*c*, 107*b*, and 107*d* of the net 107 to the ends 104*a*, 104*b* and 105*a*, 105*b* of the vertical poles 104 and 105, respectively, using fastening elements, for example, ties or cords 111, as illustrated in FIG. 1. The ties or cords 111 are tied to the knobs 115 on the upper ends 104*a* and 105*a* of the vertical poles 104 and 105, respectively, and around the base supports 102 and 103 as illustrated in FIGS. 5C-5E.

FIG. 6C illustrates an exemplary instruction list comprising constituent parts of another embodiment of the portable training apparatus 100 with a fabric bag 604. In this embodiment, the constituent parts of the portable training apparatus 100 comprise two base supports 102 and 103, constituent parts 601 and 602 of an embodiment of the horizontal pole 106, constituent parts 104*c*, 105*c* and 104*d*, 105*d* of an embodiment of the vertical poles 104 and 105, four U-shaped stakes 116, and one net 107 with a single target pocket 108*b*. Exemplary dimensions of the parts of the portable training apparatus 100 illustrated in FIG. 6C are as follows. The diameter of each of the base supports 102 and 103 is, for example, about 1.25 inches, and the length of each of the base supports 102 and 103 is, for example, about 36 inches. The diameter of each of the constituent parts 601 and 602 of the horizontal pole 106 is, for example, about 1.25 inches. The lengths of the constituent parts 601 and 602 of the horizontal pole 106 are, for example, about 40.5 inches and 40.75 inches, respectively. The diameter of each of the constituent parts 104*c*, 104*d* and 105*c*, 105*d* of the vertical poles 104 and 105, respectively, is, for example, about 1.25 inches. The length of each of the upper poles 104*c* and 105*c* of the vertical poles 104 and 105, respectively, is, for example, about 40 inches. The length of each of the lower poles 104*d* and 105*d* of the vertical poles 104 and 105, respectively, is, for example, about 41.5 inches.

In the embodiment of the portable training apparatus 100 illustrated in FIG. 6C, the exemplary instruction list instructs a user to assemble the collapsible frame 101 comprising the base supports 102 and 103, the horizontal pole 106, and the vertical poles 104 and 105 as follows. FIG. 6C illustrates assembly of an embodiment of the collapsible frame 101 of size, for example, 10 feet wide×10 feet high. The exemplary instruction list instructs the user to: (1) place the base supports 102 and 103 on a support surface; (2) position the U-shaped stakes 116 over the base supports 102 and 103 and drive the U-shaped stakes 116 into the support surface; (3) connect the constituent parts, that is, the poles 601 and 602 of the horizontal pole 106 to each other as illustrated in FIG. 6C, using, for example, the ball 106*g* and the hole 106*h* connection as disclosed in the description of FIG. 5A; (4) connect distal ends 601*a* and 601*b* of the distal poles 601 to the horizontal holders 114 of the base supports 102 and 103, respectively, using, for example, the ball 106*g* and the hole 114*a* connection illustrated in FIG. 5A; (5) connect the constituent parts of the vertical poles 104 and 105, that is, connect the upper poles 104*c*, 105*c* to the lower poles 104*d*, 105*d* of the vertical poles 104 and 105, respectively, as illustrated in FIG. 6C; and then (6) connect lower ends 104*b* and 105*b* of the bottom, lower poles 104*d* and 105*d*, respectively, to the vertical holders 113 of the base supports 102 and 103, respectively, as illustrated in FIG. 5A and FIGS. 5C-5D. In the embodiment of the portable training apparatus 100 illustrated in FIG. 6C, each of the vertical poles 104 and 105 comprises one upper pole 104*c*, 105*c* and two lower poles 104*d*, 105*d*. Furthermore, in this embodiment, the horizontal pole 106 comprises three poles, that is, two distal, angled or generally V-shaped poles 601 and one linear pole 602. Opposing ends 602*a* and 602*b* of the linear pole 602 are connected to the ends 601*b* and 601*a* of the distal poles 601, respectively, for example, using the ball 106*g* and the hole 106*h* connection as disclosed in the description of FIG. 5A.

The exemplary instruction list further instructs the user to insert the vertical poles 104 and 105 through the lateral attachment elements 110*a*, for example, the lateral tubing 110*a*, of the net 107 and to secure the bottom attachment elements 110*b* of the net 107 to the horizontal pole 106. In the embodiment of the portable training apparatus 100 illustrated in FIG. 6C, the net 107 comprises one target pocket 108*b* for catching and retaining sporting projectiles, for example, golf discs, thrown thereto. The pocket 108*b* comprises a top opening 109*a* of, for example, a generally square shape, and a bottom opening 109*b* of, for example, a generally rectangular shape, for receiving and allowing removal of the sporting projectiles, respectively. The pocket 108*b* further comprises a return channel 109*c* for directing the received sporting projectiles towards the bottom opening 109*b* of the pocket 108*b* to rest on the support surface, thereby precluding sagging of the net 107 due to weight of the sporting projectiles piled within the pocket 108*b*. The exemplary instruction list further instructs the user to secure the corners 107*a*, 107*c*, 107*b*, and 107*d* of the net 107 to the ends 104*a*, 104*b* and 105*a*, 105*b* of the vertical poles 104 and 105, respectively, using fastening elements, for example, ties or cords 111, as illustrated in FIG. 1. The ties or cords 111 are tied to the knobs 115 on the upper ends 104*a* and 105*a* of the vertical poles 104 and 105, respectively, and around the base supports 102 and 103 as illustrated in FIGS. 5C-5E.

Figure 6D:
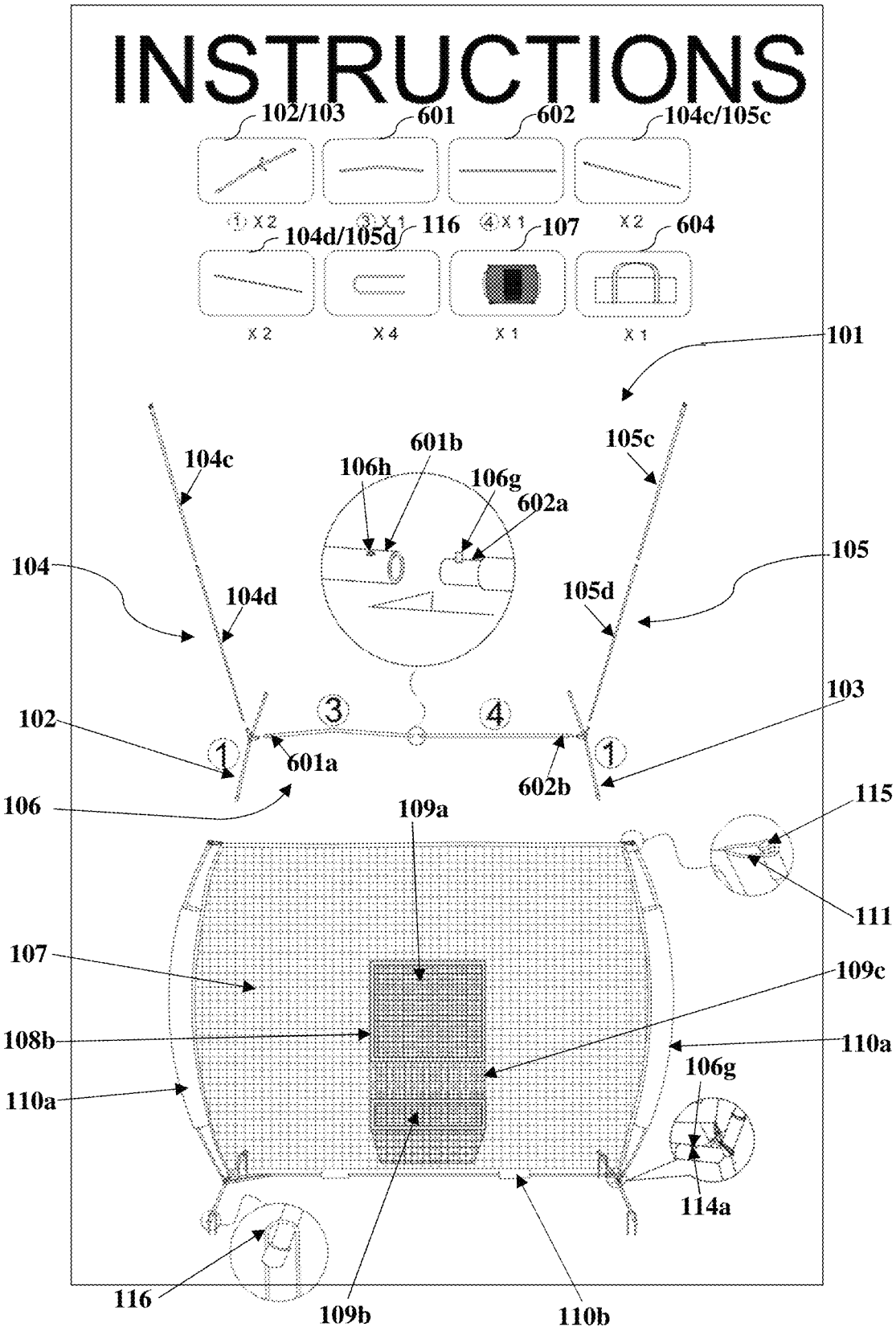

FIG. 6D illustrates an exemplary instruction list comprising constituent parts of another embodiment of the portable training apparatus 100 with a fabric bag 604. In this embodiment, the constituent parts of the portable training apparatus 100 comprise two base supports 102 and 103, constituent parts 601 and 602 of an embodiment of the horizontal pole 106, constituent parts 104*c*, 105*c* and 104*d*, 105*d* of an embodiment of the vertical poles 104 and 105, four U-shaped stakes 116, and one net 107 with a single target pocket 108*b*. Exemplary dimensions of the parts of the portable training apparatus 100 illustrated in FIG. 6D are as follows. The diameter of each of the base supports 102 and 103 is, for example, about 1.25 inches, and the length of each of the base supports 102 and 103 is, for example, about 36 inches. The diameter of each of the constituent parts 601 and 602 of the horizontal pole 106 is, for example, about 1.25 inches. The lengths of the constituent parts 601 and 602 of the horizontal pole 106 are, for example, about 40.5 inches and about 40.75 inches, respectively. The diameter of each of the constituent parts 104*c*, 104*d* and 105*c*, 105*d* of the vertical poles 104 and 105, respectively, is, for example, about 1.25 inches. The length of each of the upper poles 104*c* and 105*c* of the vertical poles 104 and 105, respectively, is, for example, about 40 inches. The length of each of the lower poles 104*d* and 105*d* of the vertical poles 104 and 105, respectively, is, for example, about 41.5 inches.

In the embodiment of the portable training apparatus 100 illustrated in FIG. 6D, the exemplary instruction list instructs a user to assemble the collapsible frame 101 comprising the base supports 102 and 103, the horizontal pole 106, and the vertical poles 104 and 105 as follows. FIG. 6D illustrates assembly of an embodiment of the collapsible frame 101 of size, for example, 7 feet wide×7 feet high. The exemplary instruction list instructs the user to: (1) place the base supports 102 and 103 on a support surface; (2) position the U-shaped stakes 116 over the base supports 102 and 103 and drive the U-shaped stakes 116 into the support surface; (3) connect the constituent parts, that is, the poles 601 and 602 of the horizontal pole 106 to each other as illustrated in FIG. 6D, using, for example, the ball 106*g* and the hole 106*h* connection as disclosed in the description of FIG. 5A; (4) connect the distal ends 601*a* and 602*b* of the poles 601 and 602, respectively, to the horizontal holders 114 of the base supports 102 and 103, respectively, using, for example, the ball 106*g* and the hole 114*a* connection illustrated in FIG. 5A; (5) connect the constituent parts of the vertical poles 104 and 105, that is, connect the upper poles 104*c* and 105*c* to the lower poles 104*d* and 105*d* of the vertical poles 104 and 105, respectively, as illustrated in FIG. 6D and as disclosed in the description of FIG. 5A; and then (6) connect lower ends 104*b* and 105*b* of the lower poles 104*d* and 105*d* of the vertical poles 104 and 105, respectively, to the vertical holders 113 of the base supports 102 and 103, respectively, as illustrated in FIG. 5A and FIGS. 5C-5D. In the embodiment of the portable training apparatus 100 illustrated in FIG. 6D, each of the vertical poles 104 and 105 comprises one upper pole 104*c*, 105*c* and one lower pole 104*d*, 105*d*. Furthermore, in this embodiment, the horizontal pole 106 comprises two poles, that is, one distal, angled or generally V-shaped pole 601 and one linear pole 602. One end 602*a* of the linear pole 602 is connected to one end 601*b* of the distal pole 601, for example, using the ball 106*g* and the hole 106*h* connection as disclosed in the description of FIG. 5A.

The exemplary instruction list further instructs the user to insert the vertical poles 104 and 105 through the lateral attachment elements 110*a*, for example, the lateral tubing, of the net 107 and to secure the bottom attachment elements 110*b* of the net 107 to the horizontal pole 106. In the embodiment of the portable training apparatus 100 illustrated in FIG. 6D, the net 107 comprises one target pocket 108*b* for catching and retaining sporting projectiles, for example, golf discs, thrown thereto. The pocket 108*b* comprises a top opening 109*a* of, for example, a generally square shape, and a bottom opening 109*b* of, for example, a generally rectangular shape, for receiving and allowing removal of the sporting projectiles, respectively. The pocket 108*b* further comprises a return channel 109*c* for directing the received sporting projectiles towards the bottom opening 109*b* of the pocket 108*b* to rest on the support surface, thereby precluding sagging of the net 107 due to weight of the sporting projectiles piled within the pocket 108*b*. The exemplary instruction list further instructs the user to secure the corners 107*a*, 107*c*, 107*b*, and 107*d* of the net 107 to the ends 104*a*, 104*b* and 105*a*, 105*b* of the vertical poles 104 and 105, respectively, using fastening elements, for example, ties or cords 111, as illustrated in FIG. 1. The ties or cords 111 are tied to the knobs 115 on the upper ends 104*a* and 105*a* of the vertical poles 104 and 105, respectively, and around the base supports 102 and 103 as illustrated in FIGS. 5C-5E.

Figure 6E:
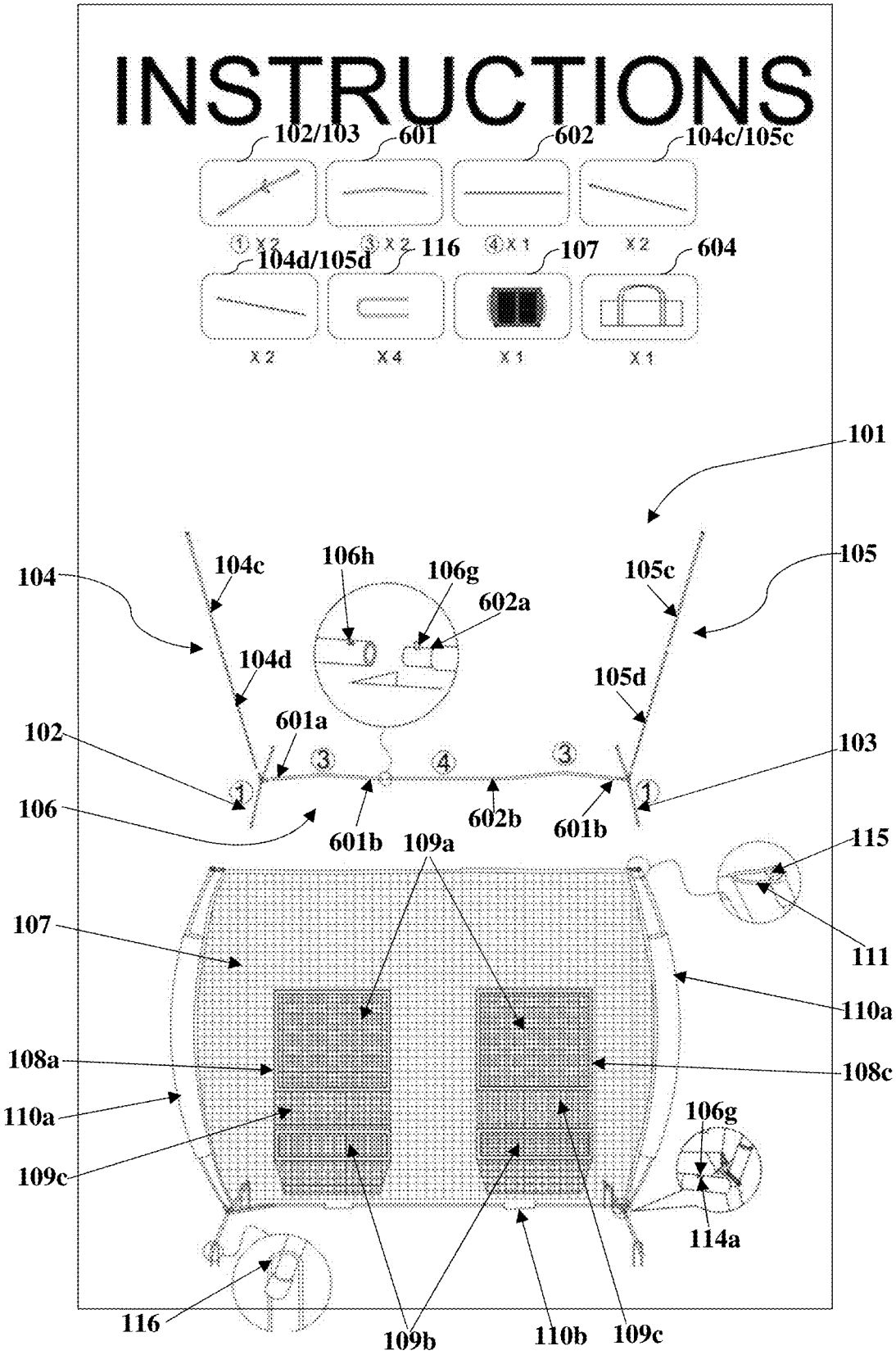

FIG. 6E illustrates an exemplary instruction list comprising constituent parts of another embodiment of the portable training apparatus 100 with a fabric bag 604. In this embodiment, the constituent parts of the portable training apparatus 100 comprise two base supports 102 and 103, constituent parts 601 and 602 of an embodiment of the horizontal pole 106, constituent parts 104*c*, 105*c* and 104*d*, 105*d* of an embodiment of the vertical poles 104 and 105, four U-shaped stakes 116, and one net 107 with two target pockets 108*a* and 108*c*. Exemplary dimensions of the parts of the portable training apparatus 100 illustrated in FIG. 6E are as follows. The diameter of each of the base supports 102 and 103 is, for example, about 1.25 inches, and the length of each of the base supports 102 and 103 is, for example, about 36 inches. The diameter of each of the constituent parts 601 and 602 of the horizontal pole 106 is, for example, about 1.25 inches. The lengths of the constituent parts 601 and 602 of the horizontal pole 106 are, for example, about 40.5 inches and 40.75 inches, respectively. The diameter of each of the constituent parts 104*c*, 104*d* and 105*c*, 105*d* of the vertical poles 104 and 105, respectively, is, for example, about 1.25 inches. The length of each of the upper poles 104*c* and 105*c* of the vertical poles 104 and 105, respectively, is, for example, about 40 inches. The length of each of the lower poles 104*d* and 105*d* of the vertical poles 104 and 105, respectively, is, for example, about 41.5 inches.

In the embodiment of the portable training apparatus 100 illustrated in FIG. 6E, the exemplary instruction list instructs a user to assemble the collapsible frame 101 comprising the base supports 102 and 103, the horizontal pole 106, and the vertical poles 104 and 105 as follows. FIG. 6E illustrates assembly of an embodiment of the collapsible frame 101 of size, for example, 10 feet wide×7 feet high. The exemplary instruction list instructs a user to: (1) place the base supports 102 and 103 on a support surface; (2) position the U-shaped stakes 116 over the base supports 102 and 103 and drive the U-shaped stakes 116 into the support surface; (3) connect the constituent parts, that is, the poles 601 and 602 of the horizontal pole 106 to each other as illustrated in FIG. 6E, using, for example, the ball 106*g* and the hole 106*h* connection as disclosed in the description of FIG. 5A; (4) connect the distal ends 601*a* and 601*b* of the distal poles 601 to the horizontal holders 114 of the base supports 102 and 103, respectively, using, for example, the ball 106*g* and the hole 114*a* connection illustrated in FIG. 5A; (5) connect the constituent parts of the vertical poles 104 and 105, that is, connect the upper poles 104*c* and 105*c* to the lower poles 104*d* and 105*d* of the vertical poles 104 and 105, respectively, as illustrated in FIG. 6E and as disclosed in the description of FIG. 5A; and then (6) connect the lower ends 104*b* and 105*b* of the lower poles 104*d* and 105*d* of the vertical poles 104 and 105, respectively, to the vertical holders 113 of the base supports 102 and 103, respectively, as illustrated in FIG. 5A and FIGS. 5C-5D. In the embodiment of the portable training apparatus 100 illustrated in FIG. 6E, each of the vertical poles 104 and 105 comprises one upper pole 104*c*, 105*c* and one lower pole 104*d*, 105*d*. Furthermore, in this embodiment, the horizontal pole 106 comprises three poles, that is, two distal, angled or generally V-shaped poles 601 and one linear pole 602. Opposing ends 602*a* and 602*b* of the linear pole 602 are connected to the ends 601*b* and 601*a* of the distal poles 601, respectively, for example, using the ball 106*g* and the hole 106*h* connection as disclosed in the description of FIG. 5A.

The exemplary instruction list further instructs the user to insert the vertical poles 104 and 105 through the lateral attachment elements 110*a*, for example, the lateral tubing, of the net 107 and to secure the bottom attachment elements 110*b* of the net 107 to the horizontal pole 106. In the embodiment of the portable training apparatus 100 illustrated in FIG. 6E, the net 107 comprises two target pockets 108*a* and 108*c* for catching and retaining sporting projectiles, for example, golf discs, thrown thereto. Each of the pockets 108*a* and 108*c* comprises a top opening 109*a* of, for example, a generally square shape, and a bottom opening 109*b* of, for example, a generally rectangular shape, for receiving and allowing removal of the sporting projectiles, respectively. Each of the pockets 108*a* and 108*c* further comprises a return channel 109*c* for directing the received sporting projectiles towards the bottom opening 109*b* of a corresponding pocket 108*a* or 108*c* to rest on the support surface, thereby precluding sagging of the net 107 due to weight of the sporting projectiles piled within the corresponding pocket 108*a* or 108*c*. The exemplary instruction list further instructs the user to secure the corners 107*a*, 107*c*, 107*b*, and 107*d* of the net 107 to the ends 104*a*, 104*b* and 105*a*, 105*b* of the vertical poles 104 and 105, respectively, using fastening elements, for example, ties or cords 111, as illustrated in FIG. 1. The ties or cords 111 are tied to the knobs 115 on the upper ends 104*a* and 105*a* of the vertical poles 104 and 105, respectively, and around the base supports 102 and 103 as illustrated in FIGS. 5C-5E.

Figure 7A:
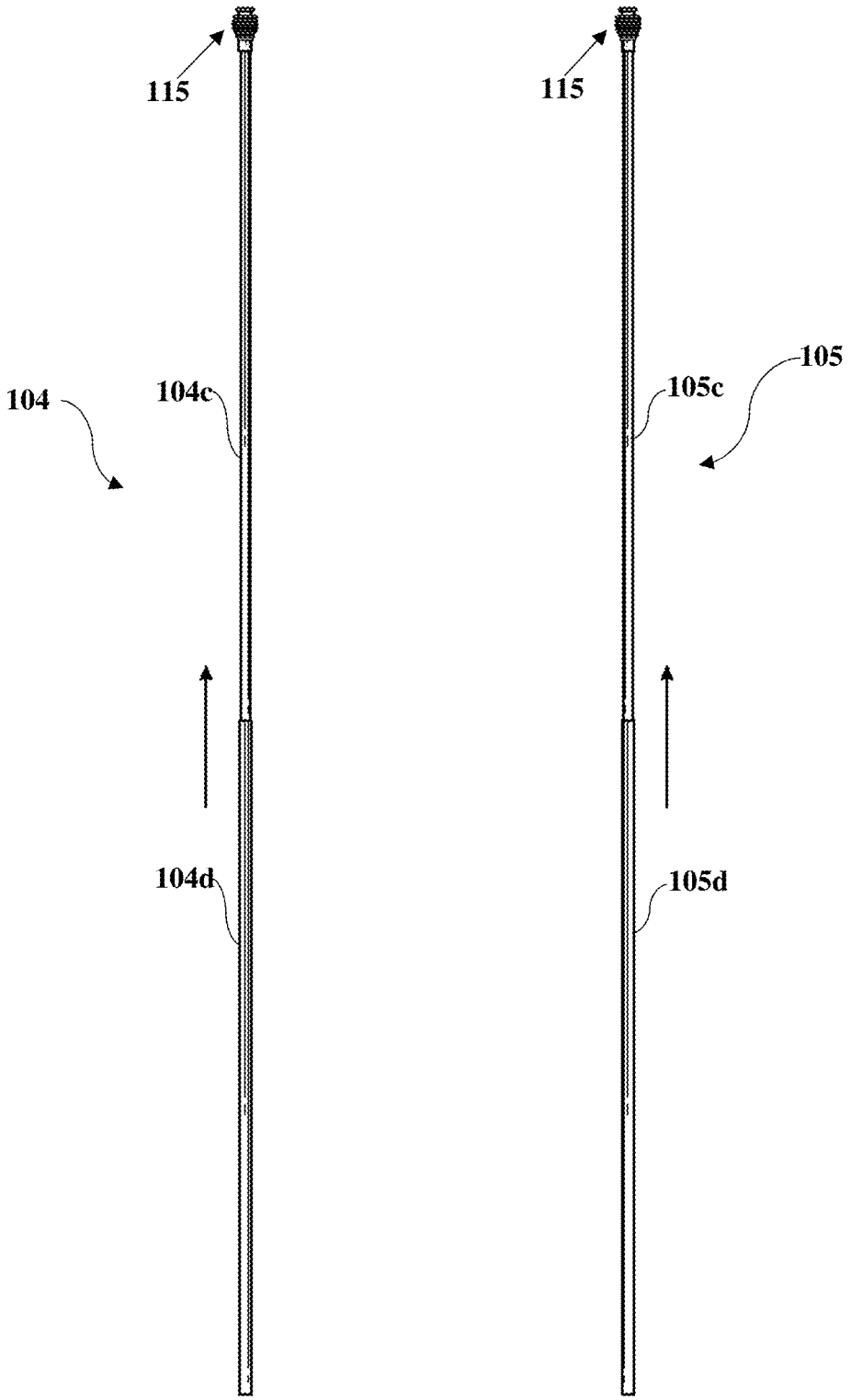
FIG. 7A illustrates an embodiment of the pair of vertical poles of the collapsible frame of the portable training apparatus, in an extended position.

FIG. 7A illustrates an embodiment of the pair of vertical poles 104 and 105 of the collapsible frame 101 of the portable training apparatus 100 shown in FIG. 1-2, in an extended position. In an embodiment, each of the pair of vertical poles 104 and 105 is a telescopic pole configured to adjust height of each of the vertical poles 104 and 105 for spanning a height of the net 107 shown in FIGS. 1-2. As illustrated in FIG. 7A, the vertical pole 104 comprises concentric tubular members, also referred to as telescopic members, configured to slide into one another. As illustrated in FIG. 7A, the vertical pole 104 comprises an upper telescopic pole 104*c* configured as an inner telescopic member, and a lower telescopic pole 104*d* configured as an outer telescopic member. Similarly, the vertical pole 105 comprises an upper telescopic pole 105*c* configured as an inner telescopic member, and a lower telescopic pole 105*d* configured as an outer telescopic member. The upper telescopic poles 104*c* and 105*c* are telescopically connected to the lower telescopic poles 104*d* and 105*d* of the vertical poles 104 and 105, respectively. In an embodiment, the upper telescopic poles 104*c* and 105*c* and the lower telescopic poles 104*d* and 105*d* are hollow cylindrical structures. The upper telescopic poles 104*c* and 105*c* are movable and slide within the lower telescopic poles 104*d* and 105*d* of the pair of vertical poles 104 and 105, respectively, for increasing and decreasing the height of the pair of vertical poles 104 and 105. The height of the pair of vertical poles 104 and 105 is adjustable for accommodating nets 107 of different sizes within the collapsible frame 101 of the portable training apparatus 100. As illustrated in FIG. 7A, the upper telescopic poles 104*c* and 105*c* are extended in an upward direction from their respective lower telescopic poles 104*d* and 105*d*, thereby increasing the height of the pair of vertical poles 104 and 105. In an embodiment, the vertical poles 104 and 105 are locked in their respective extended positions.

Figure 7B:
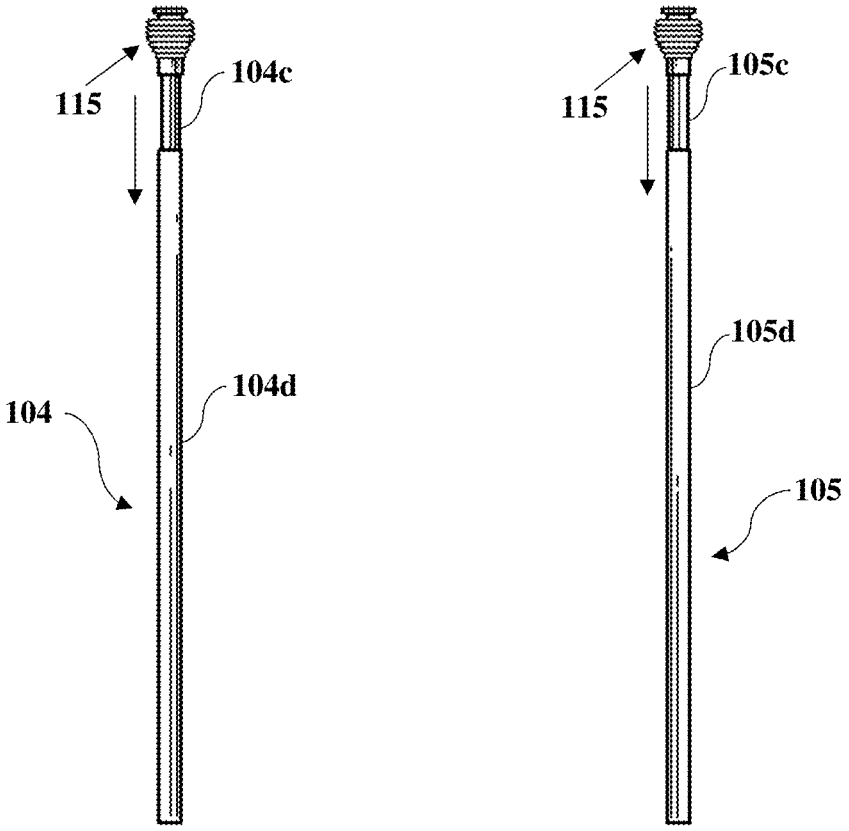
FIG. 7B illustrates the embodiment of the pair of vertical poles shown in FIG. 7A, in a retracted position.

FIG. 7B illustrates the embodiment of the pair of vertical poles 104 and 105 shown in FIG. 7A, in a retracted position. As illustrated in FIG. 7B, the upper telescopic poles 104*c* and 105*c* are retracted in a downward direction into their respective lower telescopic poles 104*d* and 105*d*, thereby decreasing the height of the pair of vertical poles 104 and 105.

Figure 8A:
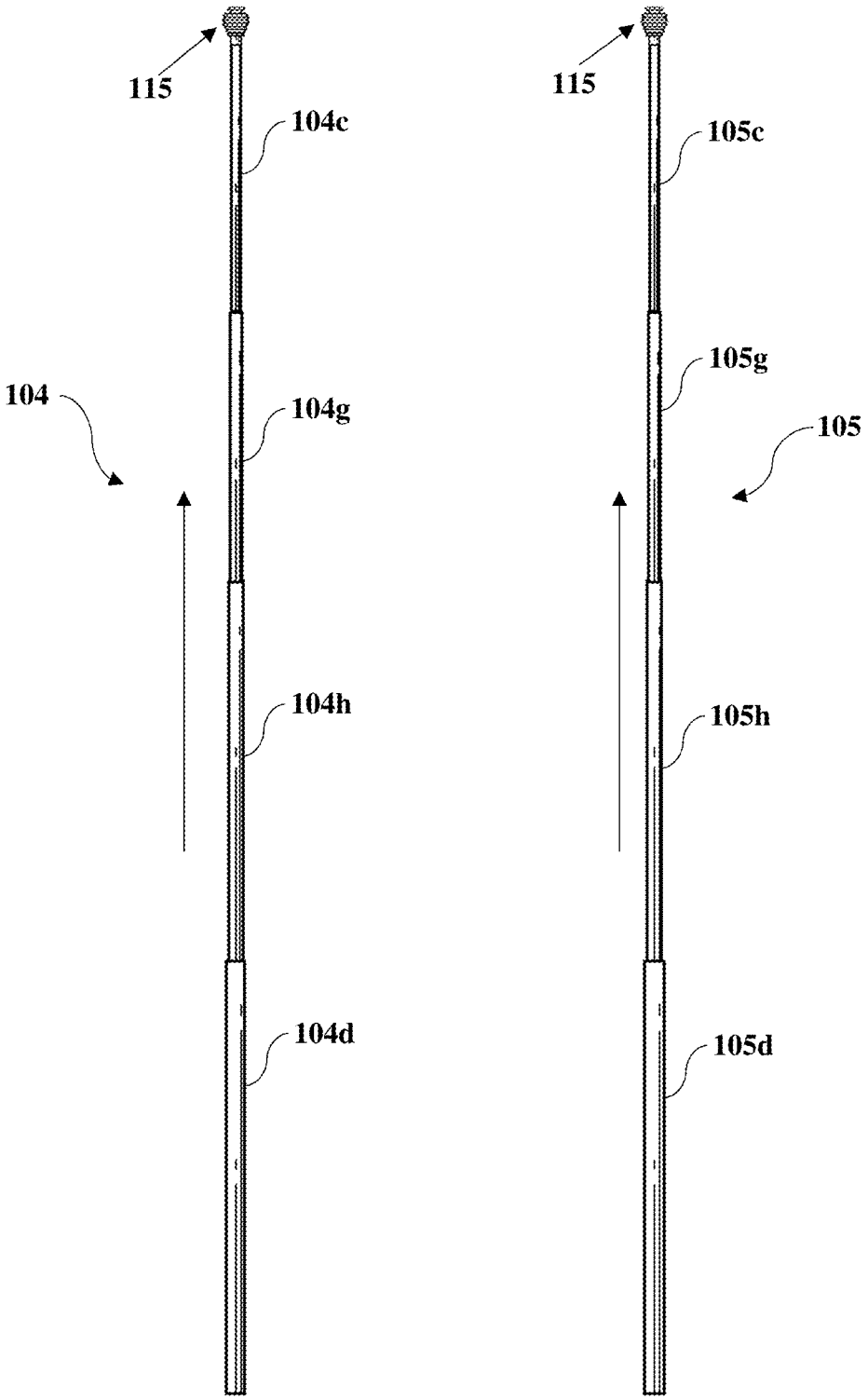
FIG. 8A illustrates another embodiment of the pair of vertical poles of the collapsible frame of the portable training apparatus, in an extended position.

FIG. 8A illustrates another embodiment of the pair of vertical poles 104 and 105 of the collapsible frame 101 of the portable training apparatus 100 shown in FIGS. 1-2 and FIGS. 10A-10B, in an extended position. In an embodiment, each of the pair of vertical poles 104 and 105 is a telescopic pole configured to adjust height of each of the vertical poles 104 and 105 for spanning a height of the net 107 shown in FIGS. 1-2. In an embodiment as illustrated in FIG. 8A, each of the vertical poles 104 and 105 comprises more than two concentric telescopic poles configured to slide into one another. For example, the vertical pole 104 comprises four telescopic poles 104*c*, 104*g*, 104*h*, and 104*d*, and the vertical pole 105 comprises four telescopic poles 105*c*, 105*g*, 105*h*, and 105*d*. The first telescopic poles 104*c* and 105*c* are telescopically connected to the second telescopic poles 104*g* and 105*g*, respectively; the second telescopic poles 104*g* and 105*g* are telescopically connected to the third telescopic poles 104*h* and 105*h*, respectively; and the third telescopic poles 104*h* and 105*h* are telescopically connected to the fourth telescopic poles 104*d* and 105*d*, respectively, as illustrated in FIG. 8A. In an embodiment, the telescopic poles 104*c*, 104*g*, 104*h*, 104*d* and 105*c*, 105*g*, 105*h*, 105*d* of the vertical poles 104 and 105, respectively, are hollow cylindrical structures. The first telescopic poles 104*c* and 105*c* are movable and slide within the second telescopic poles 104*g* and 105*g* of the pair of vertical poles 104 and 105, respectively; the second telescopic poles 104*g* and 105*g* are movable and slide within the third telescopic poles 104*h* and 105*h*, respectively; and the third telescopic poles 104*h* and 105*h* are movable and slide within the fourth telescopic poles 104*d* and 105*d*, respectively, for increasing and decreasing the height of the pair of vertical poles 104 and 105.

The height of the pair of vertical poles 104 and 105 is adjustable for accommodating nets 107 of different sizes within the collapsible frame 101 of the portable training apparatus 100. As illustrated in FIG. 8A, the upper telescopic poles are extended in an upward direction from their respective lower telescopic poles, thereby increasing the height of the pair of vertical poles 104 and 105. For example, to extend the vertical pole 104, the third telescopic pole 104*h* extends from the fourth telescopic pole 104*d*; the second telescopic pole 104*g* extends from the third telescopic pole 104*h*; and the first telescopic pole 104*c* extends from the second telescopic pole 104*g*. Similarly, to extend the vertical pole 105, the third telescopic pole 105*h* extends from the fourth telescopic pole 105*d*; the second telescopic pole 105*g* extends from the third telescopic pole 105*h*; and the first telescopic pole 105*c* extends from the second telescopic pole 105*g*. In an embodiment, when a desired height is achieved, the corresponding telescopic poles are locked in position.

Figure 8B:
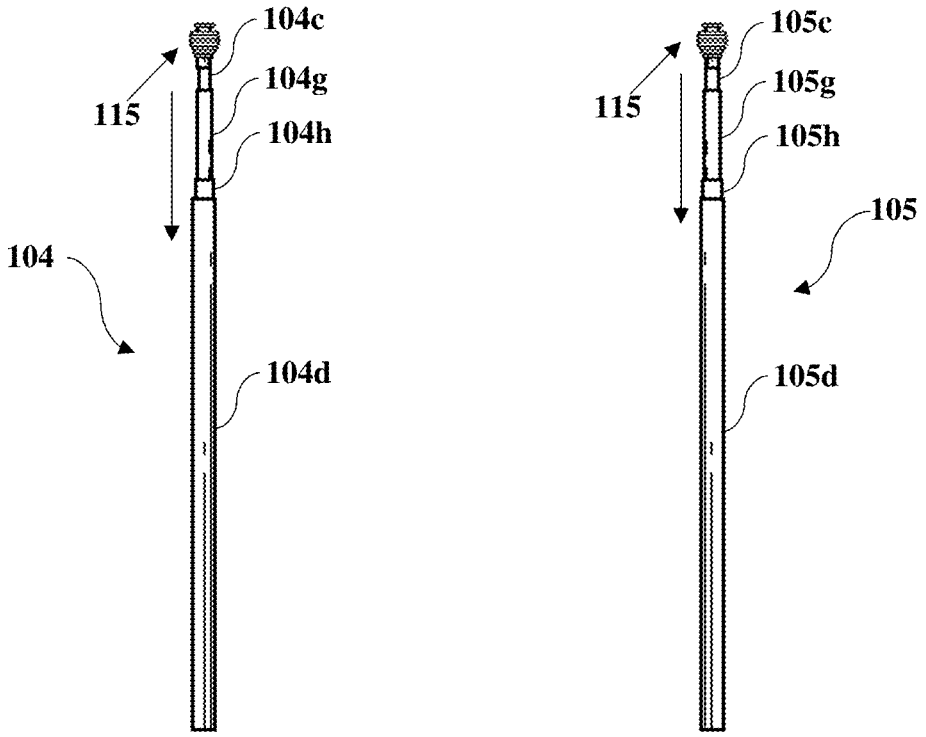
FIG. 8B illustrates the embodiment of the pair of vertical poles shown in FIG. 8A, in a retracted position.

FIG. 8B illustrates the embodiment of the pair of vertical poles 104 and 105 shown in FIG. 8A, in a retracted position. As illustrated in FIG. 8B, the upper telescopic poles are retracted in a downward direction into their respective lower telescopic poles, thereby decreasing the height of the pair of vertical poles 104 and 105. For example, the first telescopic pole 104*c* slides into the second telescopic pole 104*g*; the second telescopic pole 104*g* slides into the third telescopic pole 104*h*; and the third telescopic pole 104*h* slides into the fourth telescopic pole 104*d*, to retract the vertical pole 104. Similarly, the first telescopic pole 105*c* slides into the second telescopic pole 105*g*; the second telescopic pole 105*g* slides into the third telescopic pole 105*h*; and the third telescopic pole 105*h* slides into the fourth telescopic pole 105*d*, to retract the vertical pole 105. For purposes of illustration, the detailed description refers to each of the vertical poles 104 and 105 comprising two telescopic poles as illustrated in FIGS. 7A-7B and four telescopic poles as illustrated in FIGS. 8A-8B; however, the scope of the portable training apparatus 100 disclosed herein is not limited to each of the vertical poles 104 and 105 comprising two or four telescopic poles, but extends to include any number of telescopic poles suitable for spanning heights of nets 107 of different sizes.

Figure 9A:
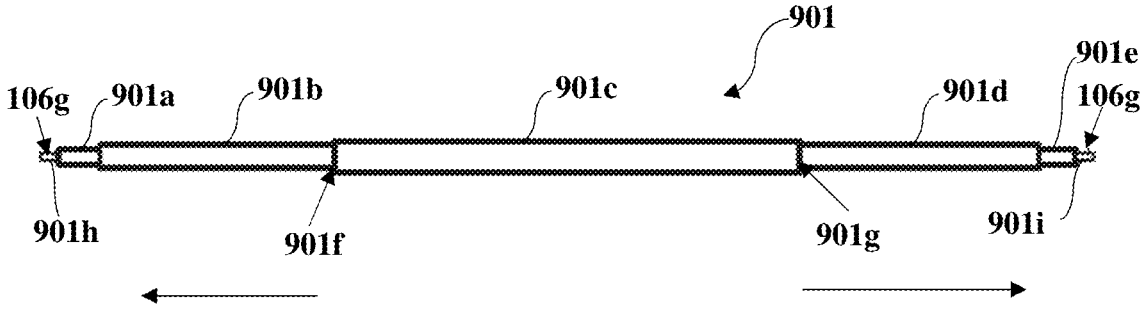
FIGS. 9A-9B illustrate embodiments of a telescopic assembly of the horizontal pole of the collapsible frame, in an extended position.
Figure 9B:
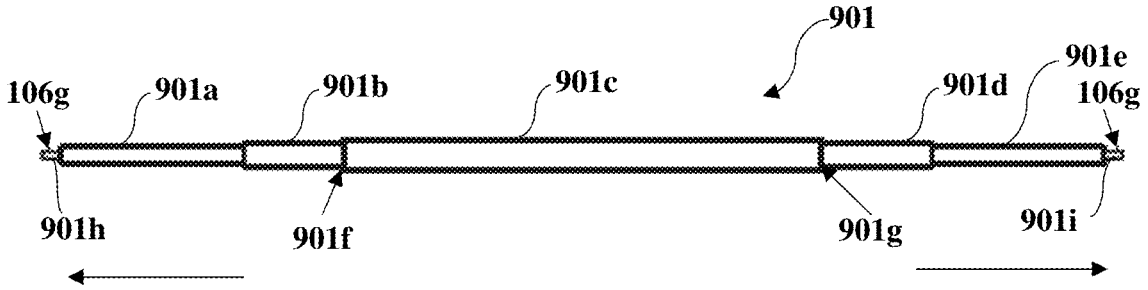
Figure 10A:
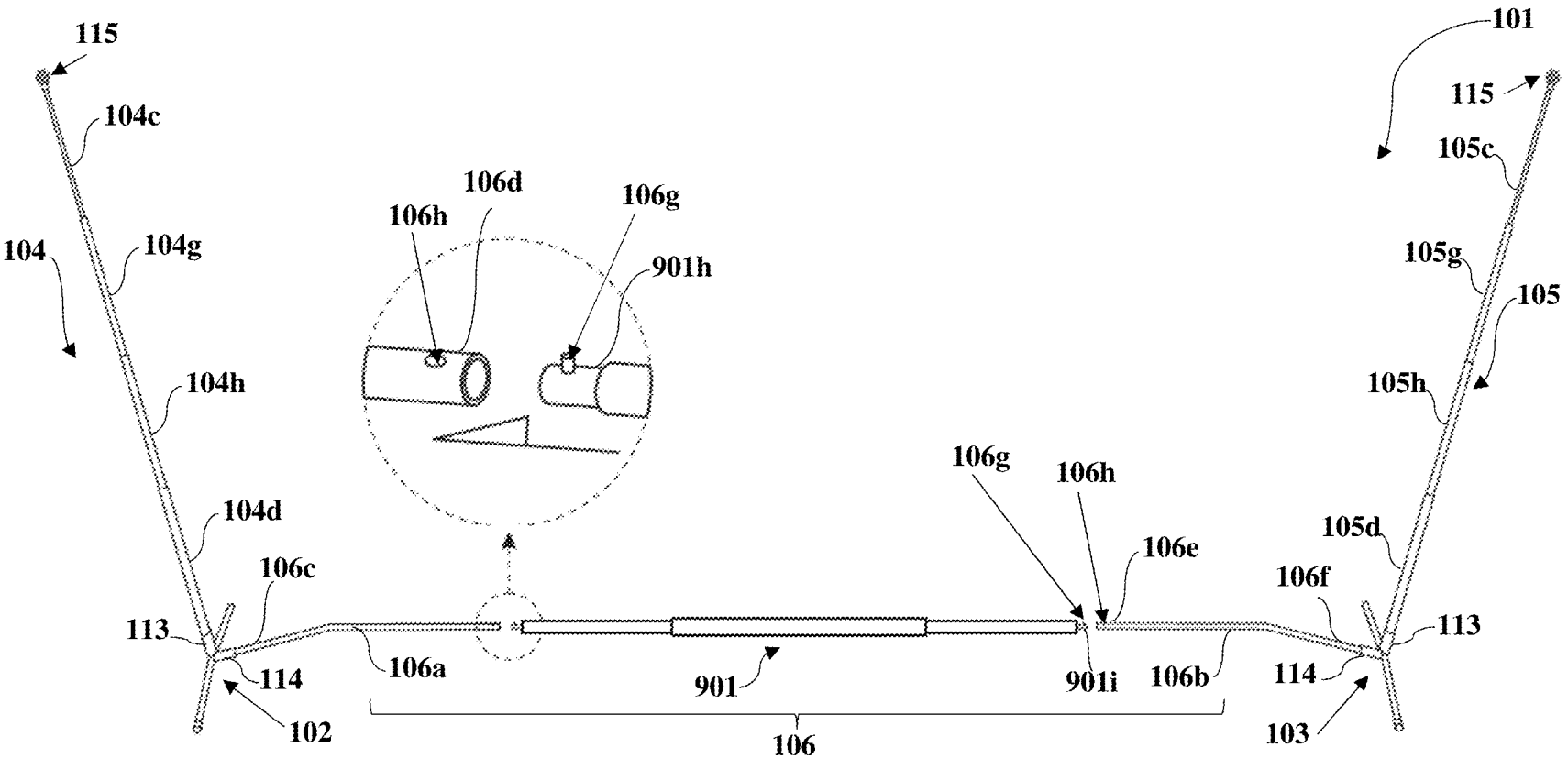
FIG. 10A illustrates a front view of an embodiment of the collapsible frame comprising the pair of vertical poles and the horizontal pole, in an extended position.

FIGS. 9A-9B illustrate embodiments of a telescopic assembly 901 of the horizontal pole 106 of the collapsible frame 101 shown in FIG. 10A, in an extended position. In an embodiment, the horizontal pole 106 is a telescopic pole configured to adjust width of the horizontal pole 106 for spanning a width of the net 107 of the portable training apparatus 100 shown in FIGS. 1-2. In an embodiment as illustrated in FIG. 10A, the horizontal pole 106 comprises two distal, angled or generally V-shaped poles 106*a* and 106*b* and an intermediate telescopic assembly 901. In an embodiment as illustrated in FIGS. 9A-9B, the telescopic assembly 901 comprises a central telescopic pole 901*c* and two concentric telescopic poles 901*a*, 901*b* and 901*d*, 901*e* connected to the opposing ends 901*f* and 901*g* of the central telescopic pole 901*c*, respectively. For purposes of illustration, the detailed description refers to the telescopic assembly 901 comprising two telescopic poles on each of the opposing ends 901*f* and 901*g* of the central telescopic pole 901*c*; however, the scope of the portable training apparatus 100 disclosed herein is not limited to the telescopic assembly 901 comprising two telescopic poles on each of the opposing ends 901*f* and 901*g* of the central telescopic pole 901*c*, but extends to include any number of telescopic poles on each of the opposing ends 901*f* and 901*g* of the central telescopic pole 901*c*, suitable for spanning widths of nets 107 of different sizes. In an embodiment, each of the opposing ends 901*h* and 901*i* of the telescopic poles 901*a* and 901*e*, respectively, comprises a ball 106*g* of a ball plunger configured to engage with a hole 106*h* configured at each of the ends 106*d* and 106*e* of the distal, angled or generally V-shaped poles 106*a* and 106*b* of the horizontal pole 106, respectively, for locking the telescopic assembly 901 therebetween as illustrated in FIG. 10A.

As illustrated in FIGS. 9A-9B, the telescopic poles 901*b* and 901*d* are telescopically connected to the opposing ends 901*f* and 901*g* of the central telescopic pole 901*c*, respectively. The telescopic poles 901*b* and 901*d* on the opposing ends 901*f* and 901*g*, respectively, slide in and out of the central telescopic pole 901*c*, for decreasing and increasing the width of the telescopic assembly 901, and in turn, the width of the horizontal pole 106, respectively. The telescopic poles 901*a* and 901*e* are telescopically connected to the telescopic poles 901*b* and 901*d*, respectively, and slide in and out of their respective telescopic poles 901*b* and 901*d*, for decreasing and increasing the width of the telescopic assembly 901, and in turn, the width of the horizontal pole 106, respectively. In an embodiment, the telescopic poles 901*a*, 901*b*, 901*c*, 901*d*, and 901*e* of the telescopic assembly 901 are hollow cylindrical structures. The telescopic assembly 901 allows adjustment of the width of the horizontal pole 106 for accommodating nets 107 of different sizes within the collapsible frame 101 of the portable training apparatus 100. As illustrated in FIG. 9A, to extend the telescopic assembly 901, the telescopic poles 901*b* and 901*d* are extended in an outward direction from the opposing ends 901*f* and 901*g* of the central telescopic pole 901*c*, respectively, thereby allowing an increase of the width of the horizontal pole 106 as disclosed in the description of FIG. 10A. Similarly, as illustrated in FIG. 9B, to extend the telescopic assembly 901, the telescopic poles 901*b* and 901*d* are partially extended in an outward direction from the opposing ends 901*f* and 901*g* of the central telescopic pole 901*c*, respectively, and the telescopic poles 901*a* and 901*e* are fully extended in an outward direction from the telescopic poles 901*b* and 901*d*, respectively, thereby allowing an increase of the width of the horizontal pole 106. In an embodiment, when a desired width is achieved, the corresponding telescopic poles are locked in position.

Figure 9C:
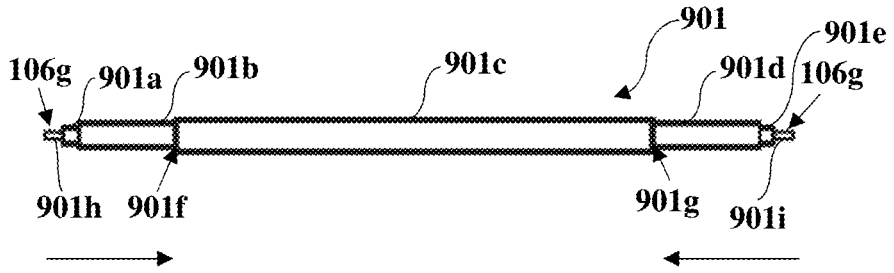
FIG. 9C illustrates an embodiment of the telescopic assembly shown in FIG. 9B, in a retracted position.

FIG. 9C illustrates an embodiment of the telescopic assembly 901 shown in FIG. 9B, in a retracted position. As illustrated in FIG. 9C, the telescopic poles 901*a* and 901*e* are retracted in an inward direction into their respective telescopic poles 901*b* and 901*d*, thereby decreasing the width of the telescopic assembly 901 and in turn, the width of the horizontal pole 106 as illustrated in FIG. 10B.

FIG. 10A illustrates a front view of an embodiment of the collapsible frame 101 comprising the pair of vertical poles 104 and 105 and the horizontal pole 106, in an extended position. As illustrated in FIG. 10A, the vertical pole 104 comprises four telescopic poles 104*c*, 104*g*, 104*h*, and 104*d*, and the vertical pole 105 comprises four telescopic poles 105*c*, 105*g*, 105*h*, and 105*d* as disclosed in the description of FIGS. 8A-8B, for adjusting the height of the vertical poles 104 and 105, and in turn, the height of the collapsible frame 101. Also illustrated in FIG. 10A, is the horizontal pole 106 comprising two distal, angled or generally V-shaped poles 106*a* and 106*b* connected to opposing ends 901*h* and 901*i* of a central telescopic assembly 901, respectively. A user may extend the telescopic assembly 901 as illustrated in FIG. 10A, and then connect the opposing ends 901*h* and 901*i* of the telescopic assembly 901 to the ends 106*d* and 106*e* of the distal, angled or generally V-shaped poles 106*a* and 106*b*, respectively. In an embodiment, the ends 106*d* and 106*e* of the distal, angled or generally V-shaped poles 106*a* and 106*b*, respectively, comprise holes 106*h* configured to receive and engage the balls 106*g* of the ball plungers configured at the opposing ends 901*h* and 901*i* of the telescopic assembly 901. As illustrated in FIG. 10A, the vertical poles 104 and 105 are extended to their maximum height, and the horizontal pole 106 is extended to its maximum width using the telescopic assembly 901, to accommodate a net 107 of a predetermined size as illustrated in FIG. 1.

Figure 10B:
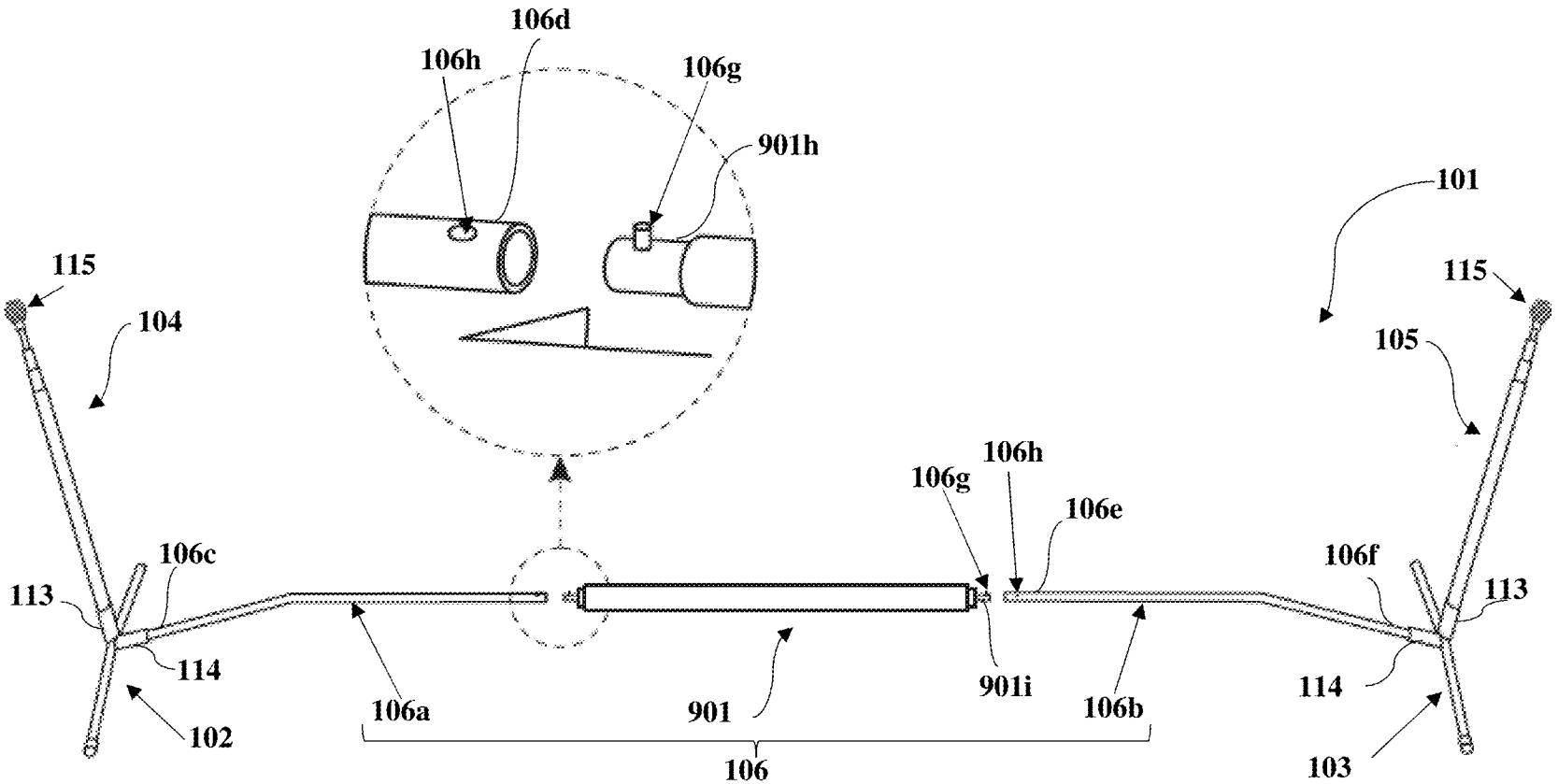
FIG. 10B illustrates a front view of an embodiment of the collapsible frame comprising the pair of vertical poles and the horizontal pole shown in FIG. 10A, in a retracted position.

FIG. 10B illustrates a front view of an embodiment of the collapsible frame 101 comprising the pair of vertical poles 104 and 105 and the horizontal pole 106 shown in FIG. 10A, in a retracted position. As illustrated in FIG. 10B, the vertical poles 104 and 105 are retracted to their minimum height, and the horizontal pole 106 is retracted to its minimum width by retracting the telescopic assembly 901. A user may disassemble the collapsible frame 101 by disconnecting the balls 106*g* of the ball plungers configured at the opposing ends 901*h* and 901*i* of the telescopic assembly 901 from the holes 106*h* at the ends 106*d* and 106*e* of the distal, angled or generally V-shaped poles 106*a* and 106*b*, respectively; disconnecting the ends 106*c* and 106*f* of the distal, angled or generally V-shaped poles 106*a* and 106*b* from the horizontal holders 114, respectively; and disconnecting the vertical poles 104 and 105 from the vertical holders 113. The user may then store the disassembled parts of the collapsible frame 101 along with the net 107 illustrated in FIG. 1, in a carry bag.

Figure 11:
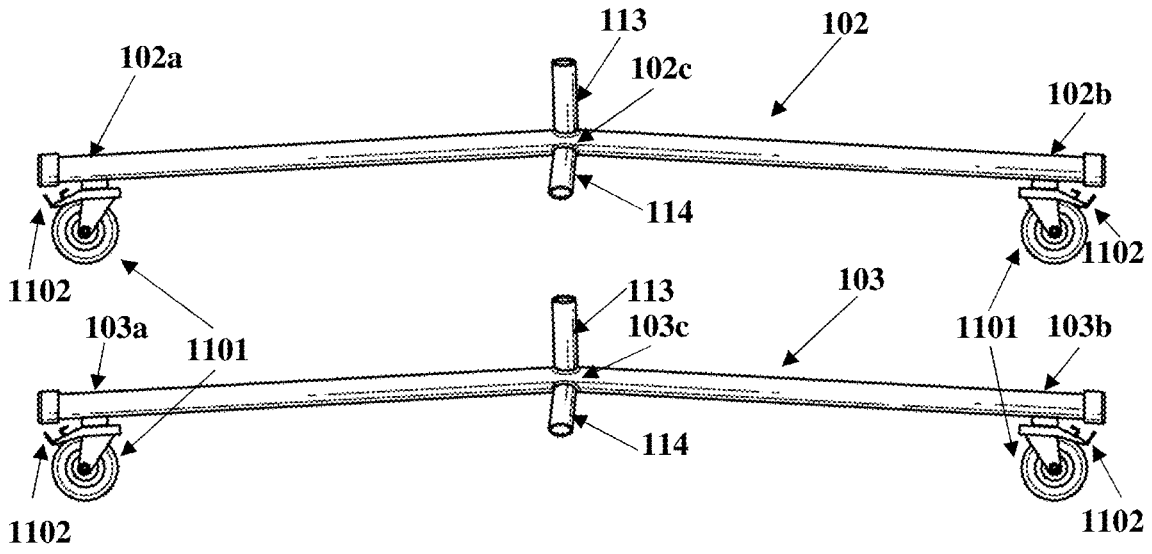
FIG. 11 illustrates an embodiment of the pair of base supports of the collapsible frame of the portable training apparatus, showing wheel assemblies operably coupled to the base supports.
Figure 12:
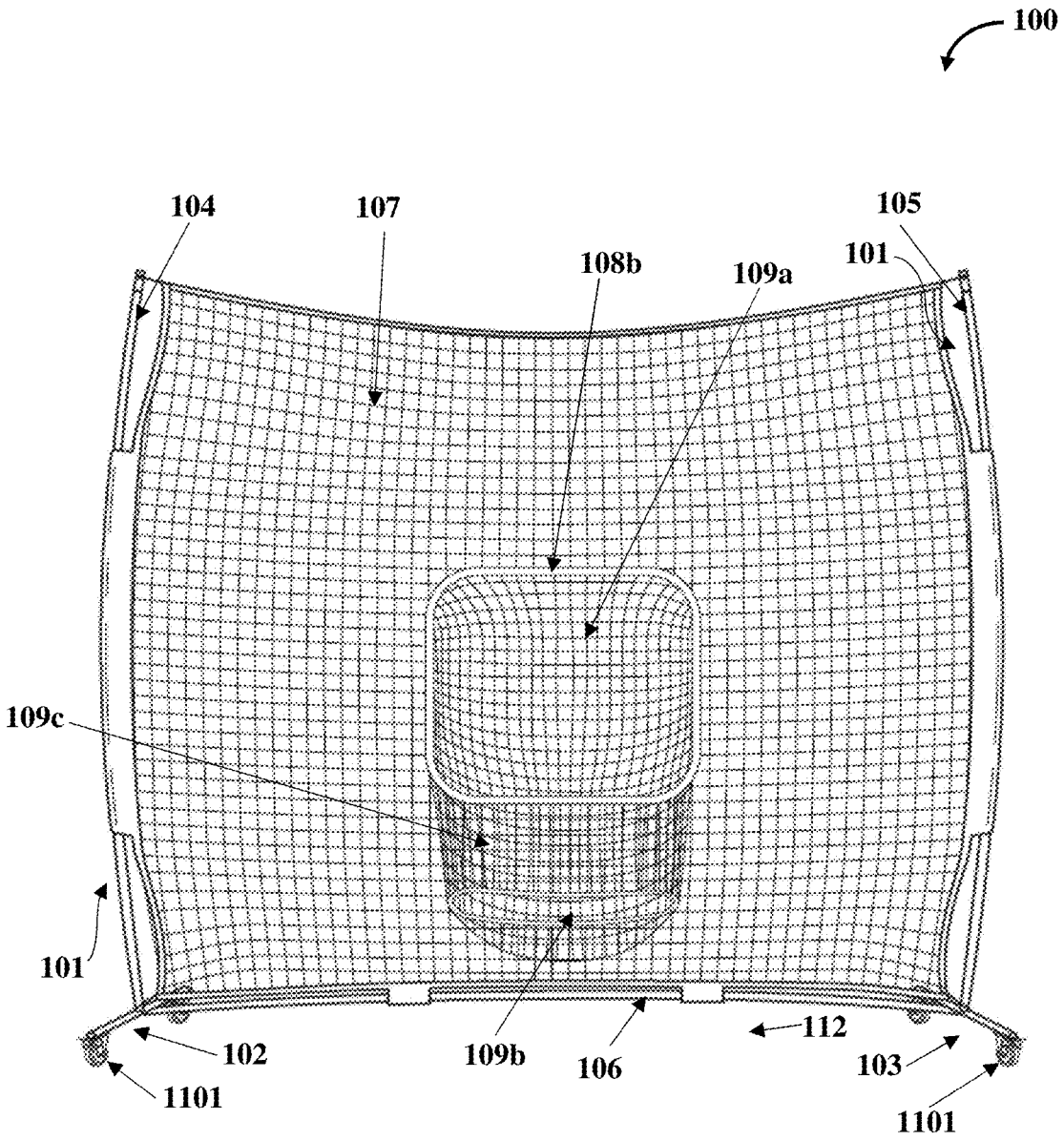
FIG. 12 illustrates a front view of an embodiment of the portable training apparatus, showing the wheel assemblies operably coupled to the base supports of the collapsible frame.

FIG. 11 illustrates an embodiment of the pair of base supports 102 and 103 of the collapsible frame 101 of the portable training apparatus 100 shown in FIG. 12, showing wheel assemblies 1101 operably coupled to the base supports 102 and 103. In an embodiment, the portable training apparatus 100 further comprises a pair of wheel assemblies 1101, for example, wear-resistant casters made of metal or a plastic material such as high-density polyethylene (HDPE). The wheel assemblies 1101 are operably coupled to the pair of base supports 102 and 103 of the collapsible frame 101. In an embodiment as illustrated in FIG. 11, the wheel assemblies 1101 are operably coupled to the opposing ends 102*a*, 102*b* and 103*a*, 103*b* of the base supports 102 and 103, respectively. In another embodiment (not shown), one wheel assembly 1101 is operably coupled to each of the mid-sections 102*c* and 103*c* of the base supports 102 and 103, respectively. The wheel assemblies 1101 are configured to move, transport, and position the portable training apparatus 100 on a support surface. A locking element 1102 is operably coupled to each of the wheel assemblies 1101. The locking element 1102 is configured to lock each of the wheel assemblies 1101 and brake the movement of the portable training apparatus 100 on the support surface. The locking element 1102 stabilizes the base supports 102 and 103 on the support surface and precludes the collapsible frame 101 from tipping when the collapsible frame 101 is in a substantially vertical, upright position. The wheel diameter, load rating, material, tread width, and overall height of the wheel assemblies 1101 are configurable to provide optimal mobility to the portable training apparatus 100 in different environments.

FIG. 12 illustrates a front view of an embodiment of the portable training apparatus 100, showing the wheel assemblies 1101 operably coupled to the base supports 102 and 103 of the collapsible frame 101. In an embodiment, the wheel assemblies 1101 are configured as swivel casters configured to turn and move the collapsible frame 101, and in turn, the portable training apparatus 100, in any direction. The locking element 1102 operably coupled to each of the wheel assemblies 1101 illustrated in FIG. 11, is configured as a lock or a brake to preclude rolling of wheels of the wheel assemblies 1101 when the portable training apparatus 100 is in place on a support surface.

Figure 13:
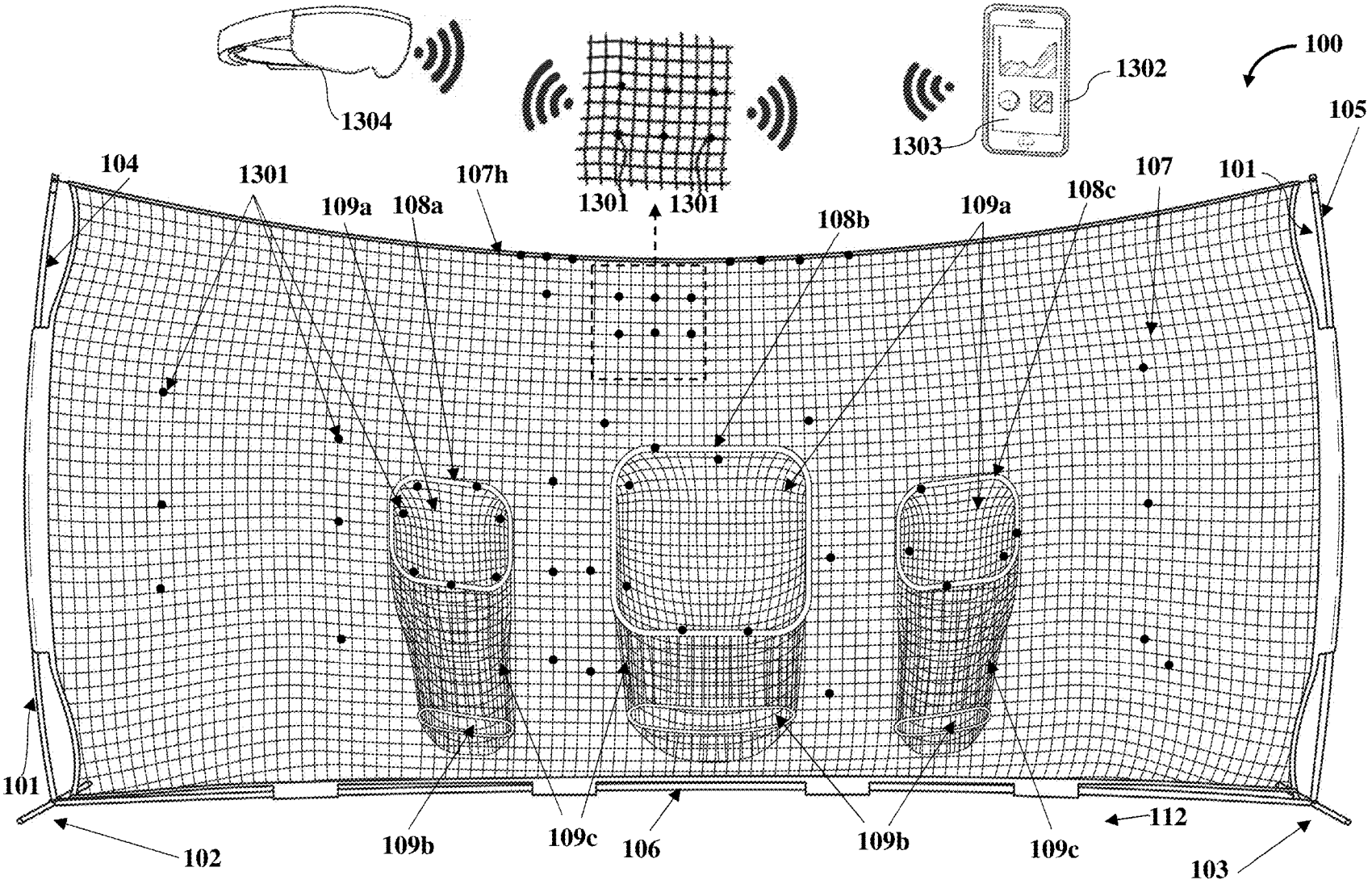
FIG. 13 illustrates a front view of a prophetic embodiment of the portable training apparatus, showing multiple sensors operably coupled to multiple predetermined locations of the net and communicatively coupled to an electronic device.

FIG. 13 illustrates a front view of a prophetic embodiment of the portable training apparatus 100, showing multiple sensors 1301 operably coupled to multiple predetermined locations of the net 107 and communicatively coupled to an electronic device 1302. The predetermined locations comprise, for example, the top opening 109*a* and the bottom opening 109*b* of each of the pockets 108*a*, 108*b*, and 108*c* of the net 107, a periphery 107*h* of the net 107, and in and/or around the pockets 108*a*, 108*b*, and 108*c* of the net 107. The sensors 1301 comprise, for example, Hall effect sensors, impact sensors such as piezoelectric film sensors, inertial sensors such as shock sensors, motion sensors, proximity sensors, force and pressure sensors, accelerometers, angular velocity sensors also referred to as gyro sensors, displacement sensors, vibration sensors, location sensors such as global positioning system (GPS) sensors or GPS-enabled sensors, sound sensors, and other sensors configured to detect motion, impacts, vibrations, speed, velocity, location, sound, etc. The sensors 1301 are configured to detect an impact of a sporting projectile 301 illustrated in FIGS. 3A-3B, on an impact location of the net 107, for example, from force and/or displacement, and measure a distance between the impact location and the top opening 109*a* of each of the pockets 108*a*, 108*b*, and 108*c* of the net 107. As used herein, "impact location" refers to a location on the net 107 where an impact of the sporting projectile 301 on the net 107 occurs. The sensors 1301 operably coupled to the top opening 109*a* of each of the pockets 108*a*, 108*b*, and 108*c* of the net 107 determine specific angles, paths, and trajectories of throws that reach the targeted pockets 108*a*, 108*b*, and 108*c* or throws that miss the targeted pockets 108*a*, 108*b*, and 108*c*. In an embodiment, one or more of the sensors 1301 also detect and measure sound within a predetermined decibel range to determine whether the sporting projectile 301 impacted the net 107. In an embodiment, one or more of the sensors 1301 comprise counters configured to count the number of throws that resulted in reaching or missing the pockets 108*a*, 108*b*, and 108*c* of the net 107. In an embodiment, the sensors 1301 are configured to communicate with sensor modules (not shown) implemented in the sporting projectile 301, to measure and generate additional performance-based sensor data, for example, rotational velocity of the sporting projectile 301 and other data for determining a flight coefficient of the sporting projectile 301, a user's grip patterns on the sporting projectile 301, etc. In an embodiment, the sensors 1301 are configured with Internet of Things (IoT) technology for transmitting real-time sensor data to the electronic device 1302 via a network.

In an embodiment, the portable training apparatus 100 further comprises a mobile application 1303 deployed on an electronic device 1302, in operable communication with the sensors 1301 on the net 107. The electronic device 1302 is, for example, one or more of a tablet computing device, a mobile computer, a mobile phone, a smart phone, a portable computing device, a laptop, a personal digital assistant, a wearable computing device such as smart glasses, smart watches, etc., a touch-centric device, a client device, a network-enabled computing device, an interactive network-enabled communication device, a gaming device, an image capture device, a portable media player, a video recorder, an audio recorder, a global positioning system (GPS) device, etc. In an embodiment, the sensors 1301 on the net 107 communicate with the electronic device 1302 via a network, for example, the internet, satellite internet, an intranet, a wired network, a wireless network, a communication network that implements Bluetooth® of Bluetooth Sig, Inc., a network that implements Wi-Fi® of Wi-Fi Alliance Corporation, an ultra-wideband (UWB) communication network, a wireless universal serial bus (USB) communication network, a communication network that implements ZigBee® of ZigBee Alliance Corporation, a general packet radio service (GPRS) network, a mobile telecommunication network such as a global system for mobile (GSM) communications network, a code division multiple access (CDMA) network, a third generation (3G) mobile communication network, a fourth generation (4G) mobile communication network, a fifth generation (5G) mobile communication network, a long-term evolution (LTE) mobile communication network, a public telephone network, etc., a local area network, a wide area network, an internet connection network, an infrared communication network, etc., or a network formed from any combination of these networks. In an embodiment, each of the sensors 1301 comprises a network interface, for example, a Bluetooth® interface, a wireless network interface such as a Wi-Fi® interface, a cellular network interface, a near field communication (NFC) interface etc., configured to connect to or be paired with the electronic device 1302.

The mobile application 1303 is configured to receive and analyze sensor data associated with the detected impact from the sensors 1301; generate analytics results from the analyzed sensor data to assist in determining performance of a user throwing the sporting projectiles 301; and generate recommendations based on the analytics results to assist in training the user. In an embodiment, the mobile application 1303 communicates with a computer system, for example, a server or a network of servers, via a network, for performing the analysis and analytical processing functions disclosed above. The analytics results provide intricate details of the user's performance thereby allowing users to review their performance and improve their throws. The analytics results comprise, for example, data, statistics, and analytics about the impact between the sporting projectile 301 and the net 107, distance of the impact location with respect to the target pockets 108*a*, 108*b*, and 108*c* of the net 107, distance of the impact location with respect to the top opening 109*a* of each of the target pockets 108*a,* 108*b,* and 108*c* of the net 107, etc. In an embodiment, the analytics results are used for reconfiguring the sensors 1301 on the net 107.

Consider an example where the electronic device 1302 receives sensor data comprising vibrations detected by one or more of the sensors 1301 on the net 107. The mobile application 1303 deployed on the electronic device 1302 analyzes the received sensor data to generate analytics and statistics regarding the impacts between the sporting projectile 301 and the net 107. In an embodiment, the mobile application 1303 generates a score for each throw based on a level of vibration detected by one or more of the sensors 1301. A throw that reaches the top opening 109*a* of a target pocket, for example, 108*b,* is determined to be a clean throw that produces substantially low vibrations. The mobile application 1303 generates a high score on analyzing a clean throw within a range of frequencies detected by one or more of the sensors 1301. Similarly, a throw resulting in substantially high vibrations, is not considered a clean throw. The mobile application 1303 generates a low score on analyzing a non-clean throw within another range of frequencies detected by one or more of the sensors 1301. In an embodiment, the mobile application 1303 generates an audible notification to a user, for example, through an audio output device of the electronic device 1302, on determining a clean throw. The mobile application 1303 generates different intermediate scores for throws resulting in vibrations within multiple intervals between high and low levels of vibrations based on their levels of vibrations.

In an embodiment, the mobile application 1303 further analyzes the sensor data to determine a throw path, a throw angle, and/or throw velocity of a sporting projectile 301, and the timing of the impact between the sporting projectile 301 and the net 107. The mobile application 1303 also generates recommendations comprising, for example, guidance, training feedback, insights, and/or instructions for making adjustments to improve the user's throwing pattern and/or style based on the analytics results. In an embodiment, the mobile application 1303 generates recommendations based on delta values related to changes in the user's performance. In an embodiment, the mobile application 1303 is configured to calibrate the sensors 1301 for adjusting thresholds, ranges for vibration levels, etc. The mobile application 1303 stores the analytics results in a database (not shown) locally and/or remotely on a server or a network of servers via a network.

In a prophetic embodiment, the sensors 1301 on the net 107 are configured to communicate with a virtual reality (VR) device 1304, for example, a VR headset, via a network, for example, a Bluetooth® network. The VR device 1304 is configured to display images of a real-world location to the user to create an immersive experience. The VR device 1304 creates a simulation and practice and/or game conditions. The VR device 1304, in communication with the sensors 1301, is configured to control the intensity of the simulation, enabling users, for example, disc golfers, to train with the same level of intensity and pressure as a real game. The images of the real-world location comprise, for example, a disc golf course, a disc golf field, a practice facility, and/or any other real-world locations selected by the user. The portable training apparatus 100, in communication with the VR device 1304, provides training in an immersive environment, thereby allowing the user to practice a variety of different throws, for example, drives, approach shots, putts, etc., in addition to training the user to adjust for different possibilities and attempts to throw the sporting projectile 301 at the target pockets 108*a,* 108*b,* and 108*c* of the net 107.

The portable training apparatus 100 operates as a training tool that allows users, for example, disc golfers, to perform a high number of repetitions (reps) of throws in a short period of time, while also fine tuning their accuracy in all their throws. The net 107, being substantially large, allows users to stand a long distance away from the net 107 and focus on where they are throwing, instead of performing repetitions of throws merely in front of the net 107. The portable training apparatus 100 allows users to train in flying disc sports, for example, disc golf and other sports, in the convenience of their own back yards. The training imparted by the portable training apparatus 100 allows a user to gain increased knowledge of their targets, allows the user to prepare for throws in any position, and also allows the user to learn proper contact, form, throw path, and/or throw angle for hitting the target pockets 108*a,* 108*b,* and 108*c* of the net 107.

After hitting the target pockets 108*a,* 108*b,* and 108*c* of the net 107, to preclude bundling up of sporting projectiles 301, thrown when a user performs multiple repetitions of throws, within the pockets 108*a,* 108*b,* and 108*c* behind the net 107, resulting in sagging of the net 107, the return channel 109*c* defined between the top opening 109*a* and the bottom opening 109*b* of each of the pockets 108*a,* 108*b,* and 108*c* funnels the sporting projectiles 301 to rest on the support surface 112, so that the net 107 remains in its original condition without sagging and the user can train at one level each time, providing more consistency in a practice game. The collapsible frame 101 operates as a universal base compatible, for example, for a 22' wide×22' high net, a 10' wide×10' high net, a 10' wide×7' high net, and other nets of different sizes. The collapsible frame 101 can be easily dissembled into constituent poles or parts, and along with the base supports 102 and 103 and the net 107, can be easily stored in a portable carry bag, for example, a fabric bag.

In addition to practicing putts by throwing the sporting projectiles 301, for example, golf discs, into the center pocket 108*b* of the net 107, the portable training apparatus 100 also allows users to practice other shots or throws, for example, drives and approach shots, in their back yard or on the go, without having to travel to a disc golf course for disc golf training and practice. Moreover, as the net 107 is configured with target pockets 108*a,* 108*b,* and 108*c* that retain the discs therewithin, the portable training apparatus 100 optimizes training sessions by reducing time it would take to find and retrieve the discs in an open field, thereby allowing users to throw many more shots in a shorter amount of time and maximizing training sessions.

The foregoing examples and illustrative implementations of various embodiments have been provided merely for explanation and are in no way to be construed as limiting of the portable training apparatus 100 disclosed herein. Dimensions of various parts of the portable training apparatus 100 disclosed above are exemplary, and are not limiting of the scope of the embodiments herein. While the portable training apparatus 100 has been described with reference to various embodiments, illustrative implementations, drawings, and techniques, it is understood that the words, which have been used herein, are words of description and illustration, rather than words of limitation. Furthermore, although the portable training apparatus 100 has been described herein with reference to particular means, materials, techniques, implementations, and embodiments, the portable training apparatus 100 is not intended to be limited to the particulars disclosed herein; rather, the portable training apparatus 100 extends to all functionally equivalent structures, methods, and uses, such as are within the scope of the appended claims. While multiple embodiments are disclosed, it will be understood by those skilled in the art, having the benefit of the teachings of this specification, that the portable training apparatus 100 disclosed herein is capable of modifications and other embodiments may be effected and changes may be made thereto, without departing from the scope and spirit of the portable training apparatus 100 disclosed herein.

I claim:

1. A portable training apparatus comprising:

a collapsible frame comprising:

a pair of base supports configured to rest on a support surface;

a pair of vertical poles corresponding to the pair of base supports, each of the vertical poles secured to a mid-section of a corresponding one of the base supports, and projecting upwards from the corresponding one of the base supports; and a horizontal pole disposed generally perpendicular to the pair of vertical poles and secured between the mid-section of each of the pair of base supports; and a net releasably secured to the pair of vertical poles and the horizontal pole of the collapsible frame, wherein the net comprises:

one or more pockets built into the net, wherein the one or more pockets are configured to retain a plurality of sporting projectiles, wherein each of the one or more pockets comprises a top opening integrated into the net for receiving the sporting projectiles, and a bottom opening integrated into the net for allowing removal of the sporting projectiles; and a plurality of sensors operably coupled to a plurality of predetermined locations on the net, wherein the sensors on the net are configured to communicate with a virtual reality (VR) device configured to create an immersive experience for a user;

wherein each of the one or more pockets comprises a loose netting return channel defined between the top opening and the bottom opening, wherein the loose netting return channel comprises a bottom surface below the bottom opening, wherein the bottom surface is is in contact with a support surface, wherein the sporting projectiles entering the loose netting return channel accumulate at the bottom surface of the loose netting return channel, and wherein sensors placed at the top opening and the bottom opening are configured to count a number of sporting projectiles accumulated at the bottom surface of the loose netting return channel; and a mobile application deployed on an electronic device of the user, wherein the mobile application is in operable communication with the plurality of sensors on the net, and wherein the mobile application is configured to receive and analyze sensor data, generate a score based analytics result, and provide recommendations based on the score based analytics result to assist in training the user.

2. The portable training apparatus of claim 1, wherein each of the sporting projectiles is one of a disc and a ball.

3. The portable training apparatus of claim 2, wherein the sporting projectiles that enter the corresponding one of the one or more pockets are directed to rest on the bottom surface which is in contact with the support surface to prevent snagging of the net caused by weight of multiple sporting projectiles accumulated within same pocket.

4. The portable training apparatus of claim 1, wherein the collapsible frame of a first size is reconfigurable into collapsible frames of multiple second sizes smaller than the first size for accommodating nets of different sizes, thereby allowing interchangeability of setups of the portable training apparatus based on user preferences.

5. The portable training apparatus of claim 1, wherein each base support of the collapsible frame is of a generally V-shape, and wherein the mid-section of each base support corresponds to a vertex of the generally V-shape, and wherein the mid-section of one of the pair of base supports faces the mid-section of another one of the pair of base supports when the collapsible frame is assembled.

6. The portable training apparatus of claim 1, wherein the mid-section of each base support of the collapsible frame comprises a vertical holder and a horizontal holder disposed substantially perpendicular to the vertical holder, wherein the vertical holder is configured to secure one of the pair of vertical poles of the collapsible frame, and wherein the horizontal holder is configured to secure one end of the horizontal pole of the collapsible frame.

7. The portable training apparatus of claim 1, wherein each of the pair of vertical poles of the collapsible frame comprises at least two poles comprising a lower pole and an upper pole detachably attachable to each other and configured to span a height of the net.

8. The portable training apparatus of claim 7, further comprising a knob affixed to an upper end of the upper pole of the each of the pair of vertical poles, wherein the knob comprises a plurality of circumferential grooves defined along a length of the knob and configured to secure the net using fastening elements.

9. The portable training apparatus of claim 1, wherein each of the pair of vertical poles of the collapsible frame is a telescopic pole configured to adjust height of the each of the pair of vertical poles for spanning a height of the net.

10. The portable training apparatus of claim 1, wherein the horizontal pole of the collapsible frame comprises at least two poles comprising a first pole and a second pole detachably attachable to each other and configured to span a width of the net.

11. The portable training apparatus of claim 1, wherein the horizontal pole of the collapsible frame is a telescopic pole configured to adjust width of the horizontal pole for spanning a width of the net.

12. The portable training apparatus of claim 1, further comprising a plurality of U-shaped stakes configured to secure the pair of base supports and the horizontal pole of the collapsible frame to the support surface.

13. The portable training apparatus of claim 1, wherein the collapsible frame is configured for disassembly and storage, and wherein the collapsible frame and the net are configured for storage within a bag.

14. The portable training apparatus of claim 1, wherein the one or more pockets comprise a pair of outer pockets configured to receive the sporting projectile thrown thereto during practicing of disc golf drives and approach shots, and wherein the one or more pockets further comprise a center pocket configured to receive the sporting projectile thrown thereto during practicing of putts, and wherein the center pocket and the pair of outer pockets are configured with multiple different dimensions.

15. The portable training apparatus of claim 1, wherein the top opening of the each of the one or more pockets is of one of a circular shape, a generally rectangular shape, a generally square shape, a polygonal shape, and an elliptical shape, and wherein the bottom opening of the each of the one or more pockets is of one of a slit shape, a circular shape, a polygonal shape, and an elliptical shape.

16. The portable training apparatus of claim 1, further comprising:

a pair of wheel assemblies operably coupled to the pair of base supports of the collapsible frame, wherein the wheel assemblies are configured to move, transport, and position the portable training apparatus on the support surface; and a locking element operably coupled to each of the wheel assemblies, wherein the locking element is configured to lock each wheel assembly and brake the movement of the portable training apparatus on the support surface.

17. The portable training apparatus of claim 1, wherein the predetermined locations comprise the top opening and the bottom opening of each pocket of the net, a periphery of the net, and in and/or around the one or more pockets of the net, wherein the sensors comprise one or more Hall effect sensors, impact sensors comprising piezoelectric film sensors, inertial sensors comprising shock sensors, motion sensors, proximity sensors, force and pressure sensors, accelerometers, angular velocity sensors comprising gyro sensors, displacement sensors, vibration sensors, location sensors comprising global positioning system (GPS) sensors or GPS-enabled sensors, or sound sensors, and wherein the sensors are configured to detect an impact of the sporting projectiles on an impact location of the net, and measure a distance between the impact location and the top opening of the each of the one or more pockets of the net.

18. The portable training apparatus of claim 1, wherein each of the pair of vertical poles of the collapsible frame comprises at least three poles comprising a lower pole, an intermediate pole, and an upper pole, wherein the lower pole is detachably attachable to the intermediate pole, and the intermediate pole is detachably attachable to the upper pole, and wherein the lower pole, the intermediate pole, and the upper pole are configured to span a height of the net.

19. The portable training apparatus of claim 1, wherein the mobile application generates a score for each throw based on a level of vibration detected by the plurality of sensors, wherein a throw that reaches the top opening of a target pocket of the one or more pockets is determined to be a clean throw that produces substantially low vibrations, wherein the mobile application generates a high score on analyzing the clean throw within a range of frequencies detected by the plurality of sensors, wherein a throw resulting in substantially high vibrations is considered an non-clean throw, wherein the mobile application generates a low score on analyzing the non-clean throw within another range of frequencies detected by the plurality of sensors, wherein the mobile application generates an audible notification to the user through an audio output device of the electronic device, on determining a clean throw, and wherein the mobile application generates different intermediate scores for throws resulting in vibrations within multiple intervals between high and low levels of vibrations based on levels of vibrations.

* * * * *